US008183746B2

(12) United States Patent
Rastegar

(10) Patent No.: US 8,183,746 B2
(45) Date of Patent: May 22, 2012

(54) METHODS AND APPARATUS FOR MECHANICAL RESERVE POWER SOURCES FOR GUN-FIRED MUNITIONS, MORTARS, AND GRAVITY DROPPED WEAPONS

(75) Inventor: Jahangir S. Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 448 days.

(21) Appl. No.: 12/407,763

(22) Filed: Mar. 19, 2009

(65) Prior Publication Data

US 2010/0236440 A1 Sep. 23, 2010

(51) Int. Cl.
*H01L 41/08* (2006.01)

(52) U.S. Cl. ..... 310/339; 102/207; 102/208; 102/209; 102/210

(58) Field of Classification Search ..... 310/339; 102/207–210
See application file for complete search history.

(56) References Cited

U.S. PATENT DOCUMENTS

| | | | | |
|---|---|---|---|---|
| 3,967,141 | A * | 6/1976 | Gawlick et al. | 310/339 |
| 3,967,555 | A * | 7/1976 | Gawlick et al. | 102/210 |
| 3,973,500 | A * | 8/1976 | Brede et al. | 102/209 |
| 7,231,874 | B2 | 6/2007 | Rastegar et al. | |
| 7,701,120 | B2 * | 4/2010 | Rastegar et al. | 310/339 |
| 7,847,421 | B2 * | 12/2010 | Gardner et al. | 290/1 R |
| 8,013,497 | B2 * | 9/2011 | Fujimoto | 310/339 |
| 2008/0129151 | A1 * | 6/2008 | Rastegar et al. | 310/329 |
| 2009/0160294 | A1 * | 6/2009 | Rastegar et al. | 310/339 |
| 2010/0199873 | A1 * | 8/2010 | Rastegar | 102/262 |
| 2011/0072703 | A1 * | 3/2011 | Ferrarini et al. | 42/1.01 |

* cited by examiner

*Primary Examiner* — Jaydi San Martin

(57) ABSTRACT

A power source including: a power generation device; a mass-spring unit having a mass and an elastic element operatively connected to the power generation device; and one or more retention fingers releasably engaged with the mass-spring unit for retaining the mass-spring unit in a position such that potential energy is stored therein and for releasing the potential energy upon occurrence of an event to generate electrical energy in the power generation device, the one or more retention fingers having a first end fixed at a base and a second end releasably engaged with the mass-spring unit. The occurrence of the event can be one or more of an acceleration and spinning of the base. Also disclosed is a power source having one or more retention fingers that are slidable with respect to a base such that the engagement of the first end is released upon a spinning of the base.

30 Claims, 14 Drawing Sheets

METHODS AND APPARATUS FOR MECHANICAL RESERVE POWER SOURCES FOR GUN-FIRED MUNITIONS, MORTARS, AND GRAVITY DROPPED WEAPONS

BACKGROUND OF THE INVENTION

1. Field of the Invention

The present disclosure relates generally to reserve electrical power sources, and more particularly, to reserve power sources for munitions such as air dropped weapons and projectiles fired by guns, mortars and the like, that are initiated during the deployment of munitions to generate power from internally stored mechanical potential energy and when applicable, used to indicate certain events that can be used to achieve safe and arm functionalities or the like.

2. Prior Art

Chemical reserve batteries have long been used in various munitions, weapon systems and other similar applications in which electrical energy is required over relatively short periods of times. In addition, unique to the military is the need for munitions batteries that may be stored for up to twenty years without maintenance. Reserve batteries are batteries designed to be stored for years, even decades, without performance degradation. Reserve batteries are stored in an inert state and can be activated within a fraction of a second with no degradation of battery capacity or power. Typical Reserve batteries are thermal batteries and liquid reserve batteries.

The typical liquid reserve battery is kept inert during storage by keeping the electrolyte separate from the electrodes. The electrolyte is kept in a glass or metal ampoule inside the battery case. Prior to use, the battery is activated by breaking the ampoule and allowing the electrolyte to flood the electrodes. The ampoule is broken either mechanically or by the high g shock experienced from being shot from the cannon.

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive.

Reserve batteries are expensive to produce, primarily since the process of their manufacture is highly labor intensive and involve mostly manual assembly. For example, the process of manufacturing thermal batteries is highly labor intensive and requires relatively expensive facilities. Fabrication usually involves costly batch processes, including pressing electrodes and electrolytes into rigid wafers, and assembling batteries by hand. The reserve batteries are encased in a hermetically-sealed metal container that is usually cylindrical in shape. In munitions, thermal batteries may be initiated during launch via inertial or electrical igniters, or may be initiated later during the flight via electrical igniters. The liquid reserve batteries are usually activated during launch by breaking the electrolyte ampoule.

Chemical reserve batteries, including thermal batteries and liquid reserve batteries, are generally very expensive to produce, require specialized manufacturing processes and equipment and quality control, and are generally required to be developed for each application at hand.

All existing and future smart and guided weapons, including gun-fired projectiles, mortars, and small and large gravity dropped weapons, require electric energy for their operation. For many fuzing operations such as fuzing "safe" and "arm" (S&A) and sensory functionalities and many other "smart" fuzing and initiation functionalities, the amount of electrical energy that is needed is low and may be as low as 10-50 mJ, and even less. In fact, with such electrical energy levels, low-power electronics could be easily powered to provide the above fuzing or the like functionalities. The amount of power required to operate many other electronic components, for example those used for diagnostics and health monitoring purposes, or for receiving a communicated signal or the like is also very small and can be readily achieved with electrical energy in the above range. In all such applications, particularly for powering electronics for fuzing and other similar "safe" and "arm" functionalities, it is highly desirable to have low-cost and safe alternatives to chemical reserve batteries. This is particularly the case for the above applications since it is generally difficult to produce very small, miniature, reserve batteries of any kind.

A need therefore exists for alternatives to chemical reserve batteries for low power applications such as fuzing electronics for "safe" and "arm" and other functionalities, and other similar low power applications. For munitions applications, such "reserve" type power sources have to have a very long shelf life of up to 20 years; be low cost; and be capable of being scaled to the required power level requirements, shape and size, with minimal design and manufacturing change efforts.

An objective is to provide non-chemical "reserve" type of power sources for the aforementioned and the like low power applications. In these power sources, mechanical potential energy can be stored in the power source and used to generate electrical energy upon occurrence of certain events, such as firing of a projectile by a gun or by the release (or ejection) of a gravity dropped weapon. This is in contrast to chemical reserve batteries in which stored chemical energy is released upon a certain event (such as firing by a gun or by an electrical charge), thereby allowing the battery to provide electrical energy.

Hereinafter, and since the source of energy in the disclosed power sources can be mechanical potential energy, these power sources are referred to as "mechanical reserve power sources".

Here, a means of storing potential mechanical energy can be elastic deformation, such as in various types of spring elements and/or the structural flexibility of the structure of the projectile or gravity dropped weapon or the like, and not potential energy due to gravity. It is, however, appreciated by those skilled in the art that potential energy may also be stored by other means such as by pressurizing compressible fluids such as air. The mechanical potential energy stored in the "mechanical reserve power sources" can then be released via certain mechanisms to be described later in this disclosure upon the occurrence of certain intended event(s), such as firing and/or spinning of a projectile or releasing of a gravity-dropped weapon or other events appropriate to the device employing the power source. The released potential energy can then be used to generate electrical energy using well known methods such as by the use of active materials based elements such as piezoelectric elements or magnet and coil type generators. To this end, the mechanical stored potential energy is preferably used to generate vibration of certain mass-spring element(s). The vibration energy is then transformed into electrical energy by one of the aforementioned piezoelectric, coil and magnet or the like elements. Alternatively, stored mechanical potential energy is used to cause a continuous (such as rotary) motion of an inertial element (e.g., an inertial wheel type element) in the form of kinetic energy. The kinetic energy can then be converted to electrical energy using well known magnet and coil type generators or any other type of available mechanical to electrical energy conversion devices (generators).

A second object is to provide methods and apparatus for releasing the stored potential energy in the disclosed "mechanical reserve power sources" using various events such as gun firing acceleration (the so-called setback acceleration) of a projectile; deceleration of gun-fired projectile (the so-called set-forward acceleration); the process and/or mechanism of releasing (e.g., gravity dropping) the weapon from its mounting rack or the like; pulling out or ejection of a releasing element (e.g., a releasing pin or wire); etc.

For the mechanical reserve power sources employing piezoelectric elements for converting mechanical energy of vibration to electrical energy, methods described for mass-spring systems used in the piezoelectric based power generators described in the U.S. Pat. Nos. 7,231,874 and 7,312,557 can generally be used in the construction of the disclosed mechanical reserve power sources, particularly for those mechanical reserve power sources to be used in gun-fired projectiles and mortars which are subject to very high-G firing acceleration levels.

In addition, in such mechanical reserve power sources, the piezoelectric elements (stacks) employed to convert mechanical energy of vibration to electrical energy may also be used as sensors to measure setback and set-forward acceleration levels, target impact impulse levels and direction, the time of such events and more as described in the patent application publication number 2007-0204756 filed on Jan. 17, 2007, the contents of which is incorporated herein by reference. In this regard, it is important to note that all existing and future smart and guided projectiles can be equipped with means for sensing one or preferably more of the firing setback and set-forward accelerations, radial accelerations, flight vibration in the longitudinal and lateral (radial) directions, and terminal point impact induced acceleration. The measurements can include the related acceleration profiles. The sensory information can be used for guidance and control purposes as well as for fuze safety and operation.

A third object is to provide methods for using the disclosed mechanical reserve power sources as the means to provide for safety in general, and "safe" and "arm" functionalities in particular, for fuzing and other similar applications in gun-fired projectiles, mortars as well as gravity dropped weapons.

A fourth object is to provide methods for allowing the disclosed mechanical reserve type power sources that rely on conversion of the stored potential energy to vibration energy and consequent conversion of the vibration energy to electrical energy to continue to harvest energy from vibration and other oscillatory motions of the weapon, from aerodynamically induced vibrations, etc., during the flight.

SUMMARY OF THE INVENTION

Accordingly, a method for the development of mechanical reserve power sources is provided. In these power sources, mechanical potential energy can be stored in elastic elements such as spring elements. The potential energy can then be released upon certain events via certain mechanisms, such as gun firing of a projectile or gravity dropping of a weapon. The released energy can then be transformed into vibration energy, which is then harvested by mechanical to electrical energy conversion elements such as piezoelectric elements or magnet and coil elements.

Accordingly, methods and apparatus for storing potential energy in the mechanical reserve power sources, and methods and apparatus for releasing the stored potential energy upon the occurrence of several events are provided. Upon the release of the stored potential energy, the potential energy can cause vibration of the power source "mass-spring" elements (or equivalent mass-spring elements when structural flexibility is used for potential energy storage purposes). Mechanical to electrical energy conversion elements, such as piezoelectric elements in stack configuration, can then be used to convert the mechanical energy of vibration to electrical energy which can then be used directly by onboard electrical and electronics components or stored in electrical energy storage devices such as capacitors.

The event upon which the stored mechanical potential energy of the disclosed mechanical reserve power sources is released and the start of electrical power generation can be used to provide "safe" and "arm" (S&A) or other similar safety functionality, particularly when the power source is used for powering fuzing means. The generated electrical energy may also be used to power electronic circuitry and/or logics used to provide additional "safe" and "arm" (S&A) functionality for fuzing or other similar applications. Accordingly, methods and apparatus for the "safe" and "arm" (S&A) or other safety functionality with and without electronics circuitry and/or logics are also provided.

The power-source "mass-spring" elements may also be configured to be excited by the vibration and rotary oscillations of the munitions during the flight, thereby allowing the power source to generate additional electrical energy. The power source may also be provided with the means to generate vibration of its "mass-spring" element during the flight due to aerodynamics forces, e.g., by the means to generate flutter.

The mechanical to electrical energy conversion may also be constructed with at least three piezoelectric elements that are configured to measure acceleration in the longitudinal and two independent radial directions, including such target impact induced accelerations (noting the term acceleration is used to also mean deceleration—or negative acceleration), thereby the level of impact force and its direction. More piezoelectric elements may also be added to measure rotary acceleration, such as spinning acceleration inside the gun barrel for rifled barrels or the like. Methods and apparatus for integrated mechanical to electrical energy converting and acceleration/impact level and direction sensing piezoelectric stacks and their configurations see application serial publication number 2007-0204756 filed on Jan. 17, 2007, the contents of which is incorporated herein by reference.

The apparatus can comprise a mass-spring system with stored mechanical energy. The mass can be a portion of the spring element. The mass can be a separate portion from the spring and attached thereto. The mass-spring system can be attached to the structure of the projectile through the aforementioned piezoelectric elements. Upon release, the stored mechanical energy can cause the mass-spring system to vibrate, which exerts a cyclic force on the piezoelectric elements, generating electrical charges in the piezoelectric elements. The magnitude of the generated charge in each piezoelectric element can be proportional to the amount of force being exerted on the said piezoelectric element and can be measured. The distribution of force exerted on the piezoelectric elements can then be used to determine the direction of the applied accelerations to the projectile during the firing or gravity drop, during the flight as a result of vibration and rotary oscillations and during the impact at the terminal point of the flight.

The apparatus can further comprise means for preloading the piezoelectric material in compression. In which case, the apparatus can further comprise means for adjusting an amount of the preloading. The preloading can be for the purpose of preventing the piezoelectric elements to be subjected to tensile forces during aforementioned firing accelerations or gravity drops, during flight vibration and rotary oscillations, and as the result of the projectile impact at the terminal point of the flight. Piezoelectric ceramics must generally be protected from tensile stresses since they are highly brittle and can readily fracture with the application of a considerable amount of tensile stress. In general, methods described in the aforementioned U.S. Pat. Nos. 7,231,874 and 7,312,557 can be used to provide such preloading mechanisms in the construction of the disclosed mechanical reserve power sources, particularly for those mechanical reserve power sources to be used in gun-fired projectiles and mortars which are subject to very high-G firing acceleration levels.

The apparatus can further comprise a housing having an internal cavity for containing the piezoelectric member and spring and mass elements in the internal cavity. The housing can also comprise means for collapsing in a direction of the acceleration to limit an amount of movement of the spring member. The apparatus can further comprise limiting means for limiting a loading on the piezoelectric member due to firing acceleration and terminal point impact. Examples of such limiting means are disclosed in the U.S. Pat. No. 7,312,557.

It is noted that the disclosed mechanical reserve power sources with integrated inertial sensors may also be used in devices that only experience high acceleration levels upon impacting certain object or medium. In such applications, the present power generators with integrated inertial sensors can be used to determine the direction of the impact and the level of impact forces that are experienced, which would also provide information as to the physical characteristics of the impacted medium (e.g., its softness, elasticity and density). The power source could then generate enough energy for onboard electronics to make appropriate decisions and initiate programmed actions.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1:
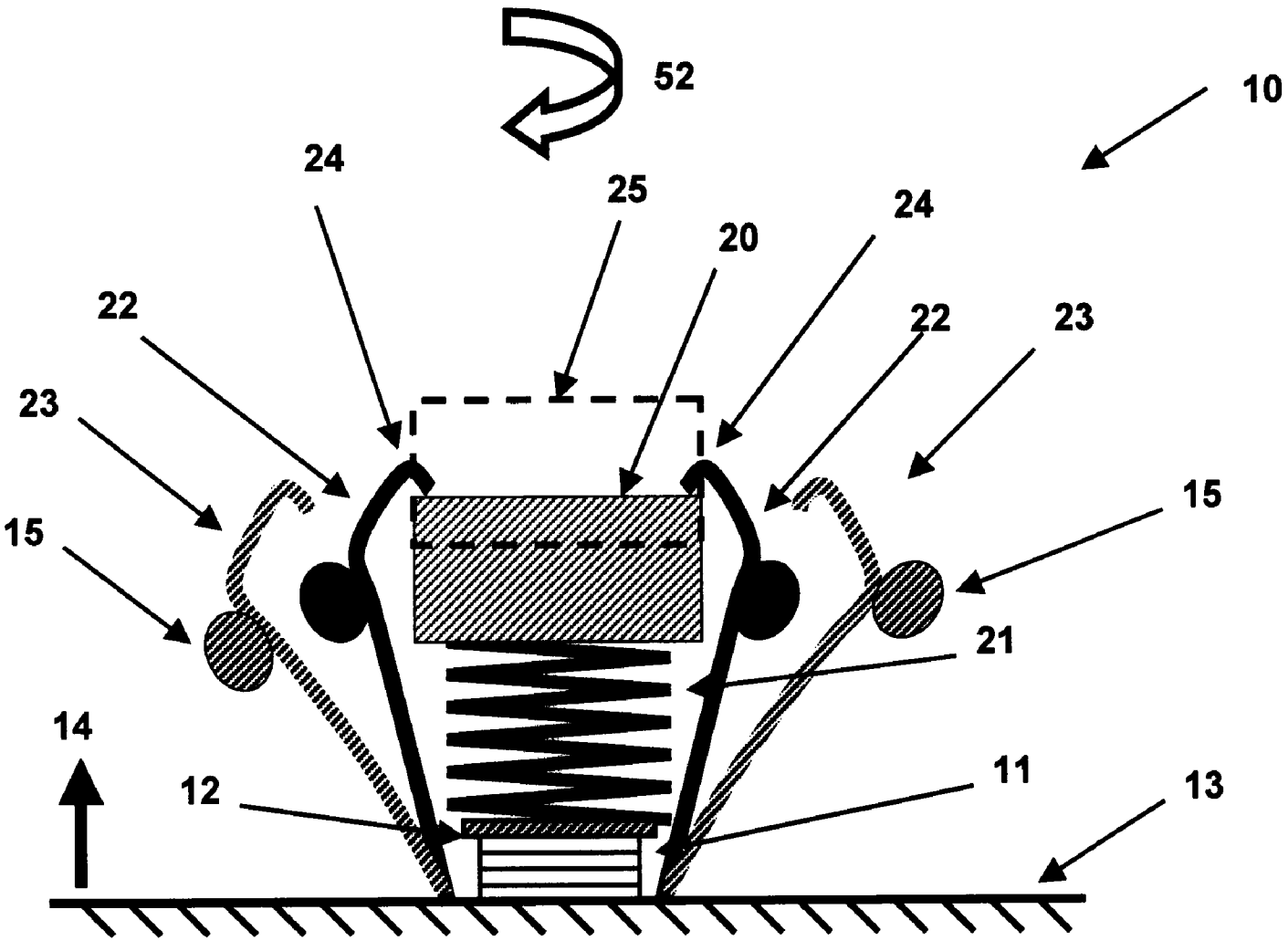
FIG. 1 illustrates a schematic of one embodiment of a mass-spring based mechanical reserve power source with piezoelectric stack mechanical to electrical energy conversion.

Although this invention is applicable to numerous and various types of devices, it has been found particularly useful in the environment of generating power onboard gun-fired and gravity dropped munitions. Therefore, without limiting the applicability of the invention to generating power onboard such munitions, the invention will be described in such environment. However, those skilled in the art will appreciate that the present methods and devices can also be used in generating power in other devices, including commercial electronic devices for direct powering of such devices and/or for charging appropriate electrical energy storage devices such as rechargeable batteries or capacitors.

In the methods and apparatus disclosed herein, the spring end (or the end of an elastic element used for the purpose of storing mechanical potential energy) of a mass-spring (or an equivalent such mass-spring system) unit is attached to a housing (support) unit via one or more piezoelectric elements, which are positioned between the spring end of the mass-spring and the housing unit. In practice, a relatively rigid element can be used as an interface element to distribute the force exerted by the spring element over the surface of one or more piezoelectric elements. A housing is intended to mean a support structure, which partially or fully encloses the mass-spring and piezoelectric elements. On the other hand, a support unit may be positioned interior to the mass-spring and/or the piezoelectric elements or be a frame structure that is positioned interior and/or exterior to the mass-spring and/or piezoelectric elements. In general, the assembly is preferably provided with means to preload the piezoelectric element in compression such that during the operation of the power generation unit, i.e., during the vibration of the mass-spring unit, tensile stressing of the piezoelectric element is substantially avoided. The entire assembly can be in turn attached to the base structure (e.g., gun-fired munitions or the gravity dropped weapon). When used in applications that subject the mechanical reserve power source unit to relatively high acceleration and/or deceleration levels, the spring of the mass-spring unit can be allowed to elongate and/or compress only within a specified limit. Once the applied acceleration and/or deceleration have substantially ended, the mass-spring unit begins to vibrate, thereby applying a cyclic force to the piezoelectric element, which in turn is used to generate electrical energy. When the base structure is a gun-fired projectile or mortar or a gravity dropped weapon or the like or any other moving platform, that undergoes vibration and oscillatory motions during the flight, such motion will also excite the mass-spring system and cause it to similarly vibrate and apply a cyclic force to the piezoelectric element, which can similarly be used to generate electrical energy. The housing structure or the base structure or both may be used to provide the limitation in the maximum elongation and/or compression of the spring of the mass-spring unit (i.e., the amplitude of vibration). Each housing unit may be used to house more than one mass-spring unit, each via at least one piezoelectric element or other energy conversion means.

Referring now to the mechanical reserve power sources shown in FIG. 1 and generally referred to by reference numeral 10. The mechanical reserve power source is considered to be mounted to the structure 13 of a gun-fired projectile, in which it is intended to start to generate electrical energy upon firing. The firing acceleration is considered to be in the direction of the arrow 14. In this embodiment, the mass 20 is attached to the piezoelectric stack 11 via the spring 21. An intermediate rigid element 12, such as one made out of stainless steel, can be used between the spring 21 and the piezoelectric stack 11 to more uniformly distribute the force applied by the spring 21 to the piezoelectric stack 11. The intermediate element 12 can be integral to the spring element 21. Similarly, the mass element 20 can be integral to the spring element 21. The spring element 21 is preferably made with at least 3 helical strands to minimize the tendency of the mass-spring element to displace laterally or bend to the side during longitudinal displacement and vibration in the direction of the arrow 14.

In its pre-firing position, the spring 21 is compressed to store the desired amount of potential energy, bringing the mass 20 to the position shown with solid lines. The mass 20 is then locked in place by at least one locking element 22 that is provided to lock the spring 21 in its compressed configuration shown by the solid lines in FIG. 1.

During the firing of the projectile, the munitions structure 13 is accelerated in the direction 14, causing the firing acceleration to act on the inertia of the at least one locking element 22 and bend it out to the position 23, thereby forcing the tip 24 of the locking elements out of engagement with the mass (or other portion of the device 10) to release the mass 20. The at least one locking element 22 may be provided with additional eccentrically positioned mass (inertia) 15 to increase the aforementioned force due to the presence of the firing acceleration for bending away the locking element 22 to its position 23 to unlock the mass 20. Such bending rotating the locking element 22 from engagement with the mass 20. Such additional mass (inertia) may be required if the firing acceleration levels are relatively low or if higher force (moment or torque) levels are required to unlock the locking element 22. In general, the locking element 22 is preferably moved and kept away from the mass 20 and spring 21 (such as by plastic deformation of at least a portion of the locking element 22 or a ratchet mechanism) so that it would not interfere with their motion (each of such movements, along with the bending discussed above, being collectively referred to herein as rotation).

Once the mass 20 is released, the mechanical potential energy stored in the spring 21, i.e., the mechanical potential energy stored in the "mechanical reserve power sources" 10, is released. The released mechanical potential energy will then cause the mass 20 and spring 21 (mass-spring unit) to vibrate. The vibration will then apply a cyclic force (push and pull) to the piezoelectric stack 11, thereby generating an electrical charge, which is then harvested and used directly or stored in certain electrical energy storage device such as a capacitor using electronic regulation and charging circuitry well known in the art.

It is noted that in the schematic of FIG. 1, the locking element is shown to be constructed as a single element with bending flexibility. However, in general, the locking mechanism may be constructed with any mechanism type that would provide the desired movement to release the mass 20 as a result of the firing acceleration in the direction of the arrow 14. Further, although the locking element 24 is shown engaged with the mass 20, it can be engaged with a portion thereof or with the spring element 21. Still further, although the spring element 21 is shown as a helical spring, it can be any elastic member that is capable of storing energy which can be released upon the firing acceleration so as to result in a vibration of the mass and/or elastic member further resulting in the application of a cyclic force on the piezoelectric stack 11 or other energy conversion means.

It is noted that the above "mechanical reserve power source" design provides for a high level of safety since zero power is provided to the projectile electronics even if the projectile is accidentally dropped over a hard surface. This is the case since the spring element 21 of the "mechanical reserve power source" 10 is preloaded to store mechanical potential energy and is locked in its preloaded configuration. The amount of preload and the locking mechanism release threshold can be readily selected such that during accidental dropping of the projectile, for example if the projectile is accidentally dropped and impacts a hard surface, the locking mechanism is not released and the preloading force is not overcome, thereby no significant amount of charges is generated by the piezoelectric stack.

Figure 2:
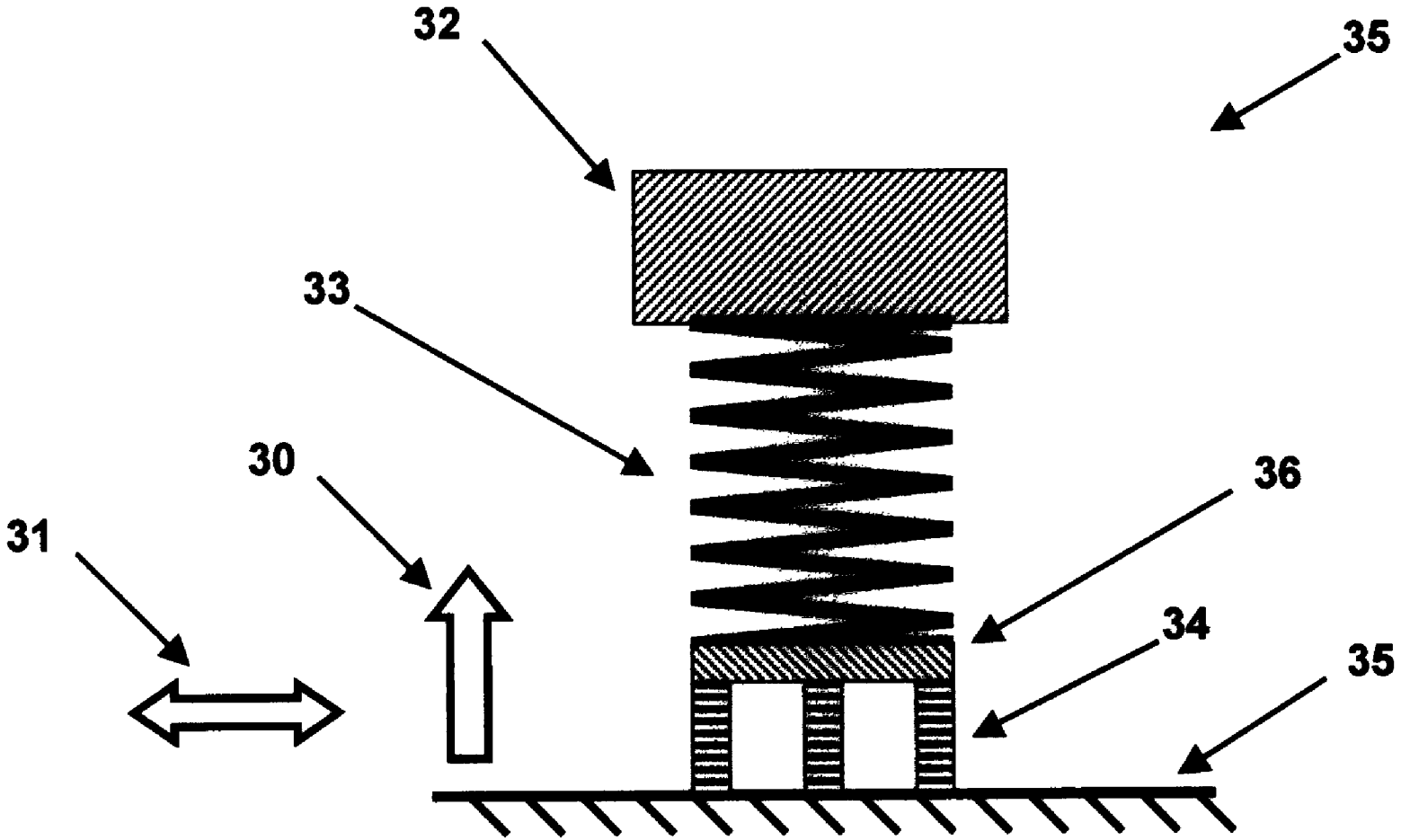
FIG. 2 illustrates an embodiment of a mass-spring unit of a mechanical reserve power source with the energy conversion piezoelectric stacks used to also act as force/moment and torque measuring sensors.

In the embodiment shown in FIG. 1, a single piezoelectric stack is used to convert mechanical energy to electrical energy. Alternatively, the piezoelectric element 11 can consist of more than one (preferably stack type) elements as shown in FIG. 2. In the schematic of FIG. 2, the locking elements 22 (FIG. 1) are not shown. In this alternative embodiment 35, the spring element 33 is also preferably attached to the piezoelectric elements 34 via a substantially rigid element 36 to distribute the forces applied by the spring element 33 more uniformly to the piezoelectric elements 34. The piezoelectric elements 14 are in turn attached (directly or via other substantially rigid elements (not shown) to the structure of the projectile 35.

During the firing, during the flight and during the impact at the terminal point of the flight, the projectile is subjected to axial and radial accelerations in the direction of the arrows 30 and 31, respectively, and rotary accelerations about the axial and radial directions.

These linear and rotational accelerations act on the inertia of the mass element 32 and the spring element 33, thereby resulting in the application of axial forces in the direction of the arrow 30; shearing forces in the direction of the arrow 31 (and the direction normal to the arrows 30 and 31—not shown for clarity); moments about the above two shearing force directions; and a moment (torque) about the direction of the above axial force to the element 36, FIG. 2. The element 36 in turn transmits the applied axial and shearing forces and moments and torque to the underlying piezoelectric elements 34. The element 36 can be integral to the spring element 33.

As described in the U.S. Provisional Patent application No. 61/158,387 filed on Mar. 8, 2009 (the contents of which are incorporated herein by reference), the level of charges (voltages) generated by the individual piezoelectric elements 34 as a result of the application of the aforementioned axial and shearing forces and moments and torque are measured and used to determine the level of at least one of the said applied forces, moments and torque. These measurements are made while the said charges are harvested. Noting that the said forces, moments and torque are proportional to the aforementioned linear and rotary accelerations that are experienced by the projectile, the said levels of measured forces and/or moments and/or torque would also provide the levels of at least one of the related aforementioned linear and/or rotary accelerations.

As a result, the device 35 can function both as a mechanical reserve power source and an accelerometer and/or force (moment and/or torque) sensor. Such an integrated power source and acceleration and/or force (moment and/or torque) sensor device, will significantly reduce the overall size and volume that would have been occupied by currently available and separate power source units and acceleration and force (moment and torque) sensor units. Such integrated power source and acceleration and force (moment and torque) sensor units are of particular need in applications such as gun-fired munitions, mortars and the like where such devices have to occupy minimal volume in order to allow room in the projectile for other components of the munitions that are required to make the projectile effective.

It is noted that in gun-fired munitions applications, the piezoelectric based power generators can be designed as described in the U.S. Pat. Nos. 7,231,874 and 7,312,557 so that they could withstand high firing accelerations and target impact forces that are generally experienced by gun-fired munitions, mortars and the like.

Figure 3:
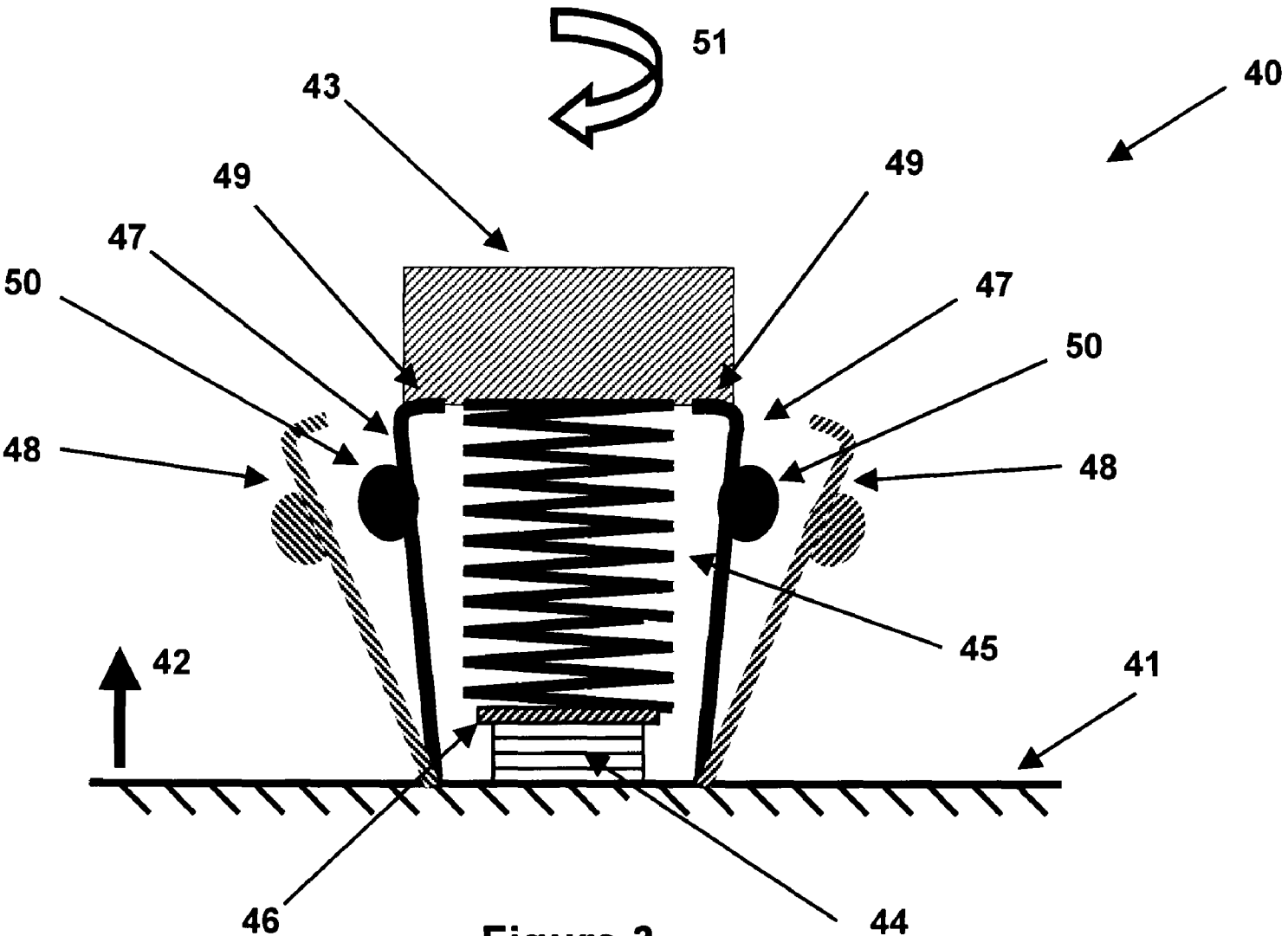
FIG. 3 illustrates an embodiment of a mass-spring and piezoelectric based mechanical reserve power source similar to the embodiment of FIG. 1 with the spring element preloaded in tension.

In the embodiment shown in FIG. 1, the mechanical potential energy is stored in the spring element 21 of the mechanical reserve power source 10 by preloading the spring element in compression. Alternatively, the mechanical reserve power source may be designed such that the mechanical potential energy is stored in a spring element which is preloaded in tension. The schematic of such an embodiment 40 is shown in the schematic of FIG. 3. The mechanical reserve power source 40 is considered to be mounted to the structure 41 of a gun-fired projectile, in which it is intended to start to generate electrical energy upon firing. The firing acceleration is considered to be in the direction of the arrow 42. The mass element 43 is attached to the piezoelectric stack 44 via the spring 45, via an intermediate rigid element 46 to more uniformly distribute the force applied by the spring element 45 to the piezoelectric stack 44. The intermediate element 46 and the mass element 43 can be integral to the spring element 45. The spring element 45 can be formed with at least 3 helical strands to minimize the tendency of the mass-spring element to displace laterally or bend to the side during longitudinal displacement and vibration in the direction of the arrow 42.

In its pre-firing position, the spring element 45 is preloaded in tension to store the desired amount of mechanical potential energy. This is done by bringing the mass element 43 to the position shown in FIG. 3, and locking it in place with at least one locking element 47, in this case by preventing the mass element 43 from traveling downwards (opposite the direction of acceleration).

During the firing of the projectile, the munitions structure 41 is accelerated in the direction 42, causing the firing acceleration to act on the inertia of the at least one locking element 47 and bend it out of engagement with the mass 43 to the position 48, thereby forcing the tip 49 of the locking elements to release the mass 43. The at least one locking element 47 may be provided with additional eccentrically positioned mass (inertia) 50 to increase the aforementioned force moving the locking element 47 to its position 48 to release the mass element 43. Such additional mass (inertia) may be required if the firing acceleration levels are relatively low or if higher force (moment or torque) levels are required to displace the locking element 47. In general, the locking element 47 can be moved and kept away from the mass element 43 and spring element 45 (such as by plastic deformation of at least a portion of the locking element 47 or a ratchet mechanism) so that it would not interfere with their subsequent vibration. Once the mass element 43 is released, the mechanical potential energy stored in the spring element 45, i.e., the mechanical potential energy stored in the mechanical reserve power sources 40, is released. The released mechanical potential energy will then cause the mass element and spring element 45 (mass-spring unit) to vibrate. The vibration will then apply a cyclic force to the piezoelectric stack 44, thereby generating an electrical charge, which is then harvested and used directly or stored in certain electrical energy storage device such as a capacitor using electronic regulation and charging circuitry well known in the art.

In the embodiments 10 and 40 shown in FIGS. 1 and 3, respectively, the locking elements 22 and 47 are shown to be released by the (axial) acceleration 14 and 42. Alternatively, the locking mechanisms of the disclosed mechanical reserve power sources may be designed to be released by accelerations in the lateral directions or due to rotational accelerations. In all such cases, the locking mechanism can be provided with mass (inertia) elements similar to mass 15 (FIG. 1) or mass 50 (FIG. 3), such that the applied acceleration acts on the indicated mass, generating forces (moments or torques) that would act to release the locking mechanism, such as was described for the aforementioned embodiments 10 and 40.

In the particular case of the embodiments 10 and 40 shown in FIGS. 1 and 3, respectively, the rotational spin (shown by the arrows 52 and 51, respectively) of the base structure 13 and 41 would also generate a centripetal acceleration that acts on the masses 15 and 50, forcing the locking elements to release the locked masses 20 and 43 to begin to vibrate. Such rotational spin is commonly applied to gun-fired projectiles and in many cases to mortars and missiles for stabilization purposes during the flight. In such applications, the projectile spinning—alone or in combination of the aforementioned axial acceleration—may be used to release the locking mechanism in the disclosed embodiments of the mechanical reserve power sources.

In general, the locking mechanisms are preloaded in the direction opposing their release. For example in the embodiment 10 of FIG. 1, the locking elements 22 (acting as flexural spring element) are preferably preloaded such that normally they would press against the mass element 20. The purpose of this preloading and the threshold force for the release of the locking element 22 is to prevent accidental release of the locking mechanism such as in the case of accidental drops or other unintended acceleration or spinning of the projectile 13.

The amount of preload of the springs 21 and 45 of the mechanical reserve power sources of the embodiments of FIGS. 1 and 3 and the locking mechanism release threshold can be selected such that during accidental dropping of the power source and/or projectile (device) in which they are mounted, the springs 21 and 45 do not transmit any significant amount of force to the piezoelectric stack elements 11 and 44, respectively, thereby no significant amount of charges is generated by the said piezoelectric stacks, thereby providing for a high level of safety for the system employing these power sources.

Figure 4:
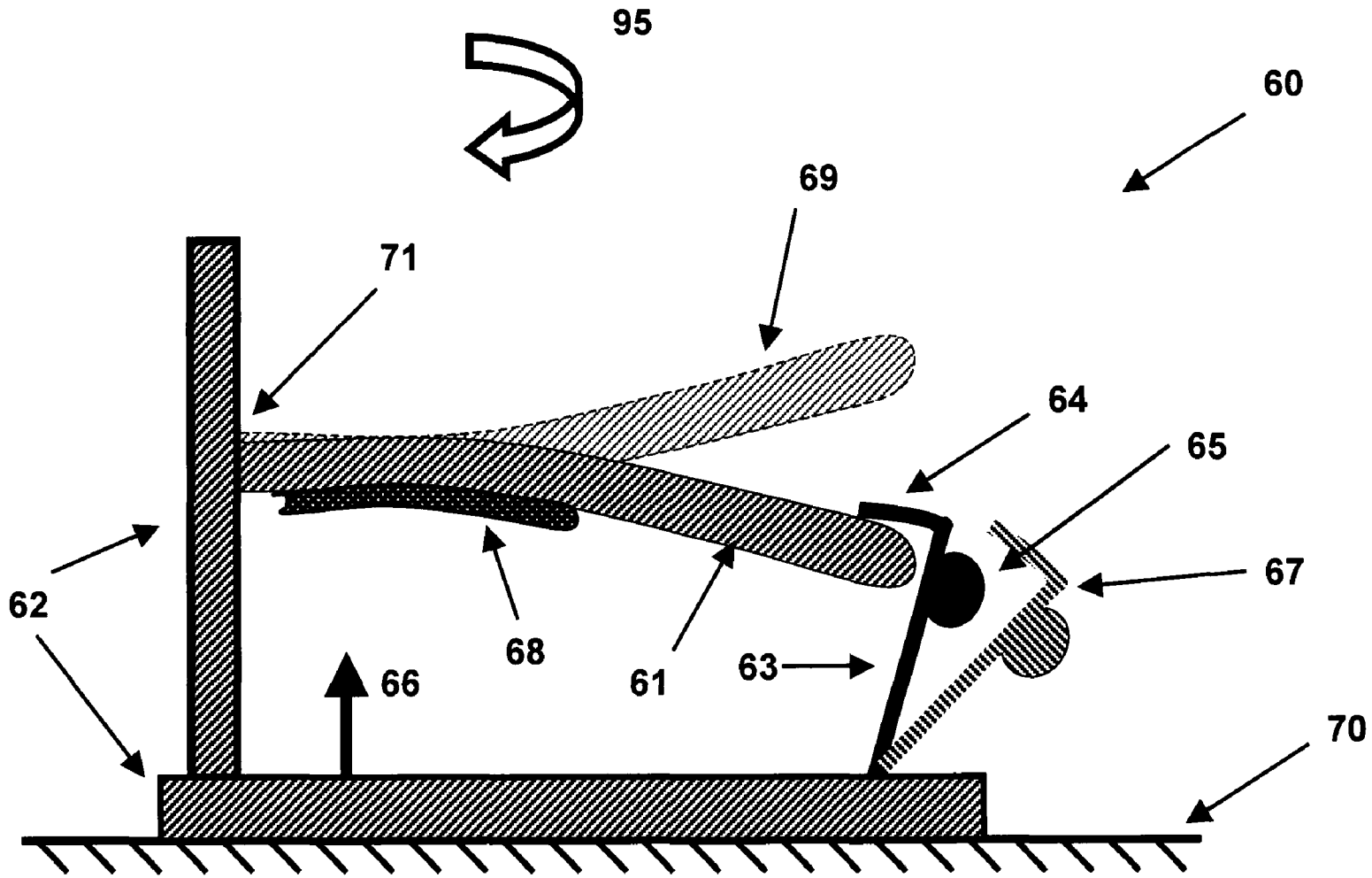
FIG. 4 illustrates a schematic of an embodiment of the mass-spring based mechanical reserve power source with piezoelectric film mechanical to electrical energy conversion elements in which the mass-spring unit includes a vibrating beam.

In another embodiment 60 shown schematically in FIG. 4, the mechanical potential energy storage element (spring element in the embodiments of FIGS. 1 and 3) of the mechanical reserve power source is a relatively flexible beam 61. The base structure of the mechanical reserve power source 62 is attached to base structure of the munitions 70, such as a gun-fired projectile in which it is intended to start to generate electrical energy upon firing. The flexible beam 61 is then in turn attached to the power source base structure 62 at the point 71.

The firing acceleration is considered to be in the direction of the arrow 66. At least one piezoelectric element 68, preferably a relatively thin element designed to generate a charge when subjected to tensile and compressive stresses in the longitudinal direction of the beam is then attached to at lease one side (and can also be attached to more than one side) of the beam top and bottom surfaces. The piezoelectric elements can be attached closer to the fixed end of the beam and in their normal position (substantially straight), i.e., when the beam is not subjected to flexural bending, are preloaded in compressive stress such that as the beam vibrates up and down as shown in the general lower position 61 and general upper position 69.

In its pre-firing position, the flexible beam is preloaded in bending to the position 61 from its unloaded (normal) position (not shown) to store the desired amount of mechanical potential energy. The preloaded flexible beam 61 is then locked in its position 61 by the tip 64 of at least one locking element 63 as shown in FIG. 4.

During the firing of the projectile, the munitions structure 70 is accelerated in the direction 66, causing the firing acceleration to act on the inertia of the at least one locking element 63 and bend it out to the position 67, thereby forcing the tip 64 of the locking element 63 to release the flexible beam 61. The at least one locking element 63 may be provided with additional eccentrically positioned mass (inertia) 65 to increase the aforementioned force that acts on the locking element 63 and tend to move it to the position 67 to release the flexible beam 61. Such additional mass (inertia) may be required if the firing acceleration levels are relatively low or if higher force (moment or torque) levels are required to displace the locking element 63. In general, the locking element 63 can be moved towards the position 67 and kept away from the flexible beam 61 (such as by plastic deformation of at least a portion of the locking element 63 or a ratchet mechanism) so that it would not interfere with its subsequent vibration. Once the flexible beam 61 is released, the mechanical potential energy stored in the flexible beam 61, i.e., the mechanical potential energy stored in the present embodiment of the mechanical reserve power sources 60, is released. The released mechanical potential energy will then cause the flexible beam 61 to vibrate. The vibration will then apply a cyclic tensile and compressive stresses to the at least one piezoelectric 68, thereby generating an electrical charge, which is then harvested and used directly or stored in certain electrical energy storage device such as a capacitor using electronic regulation and charging circuitry well known in the art.

Figure 5:
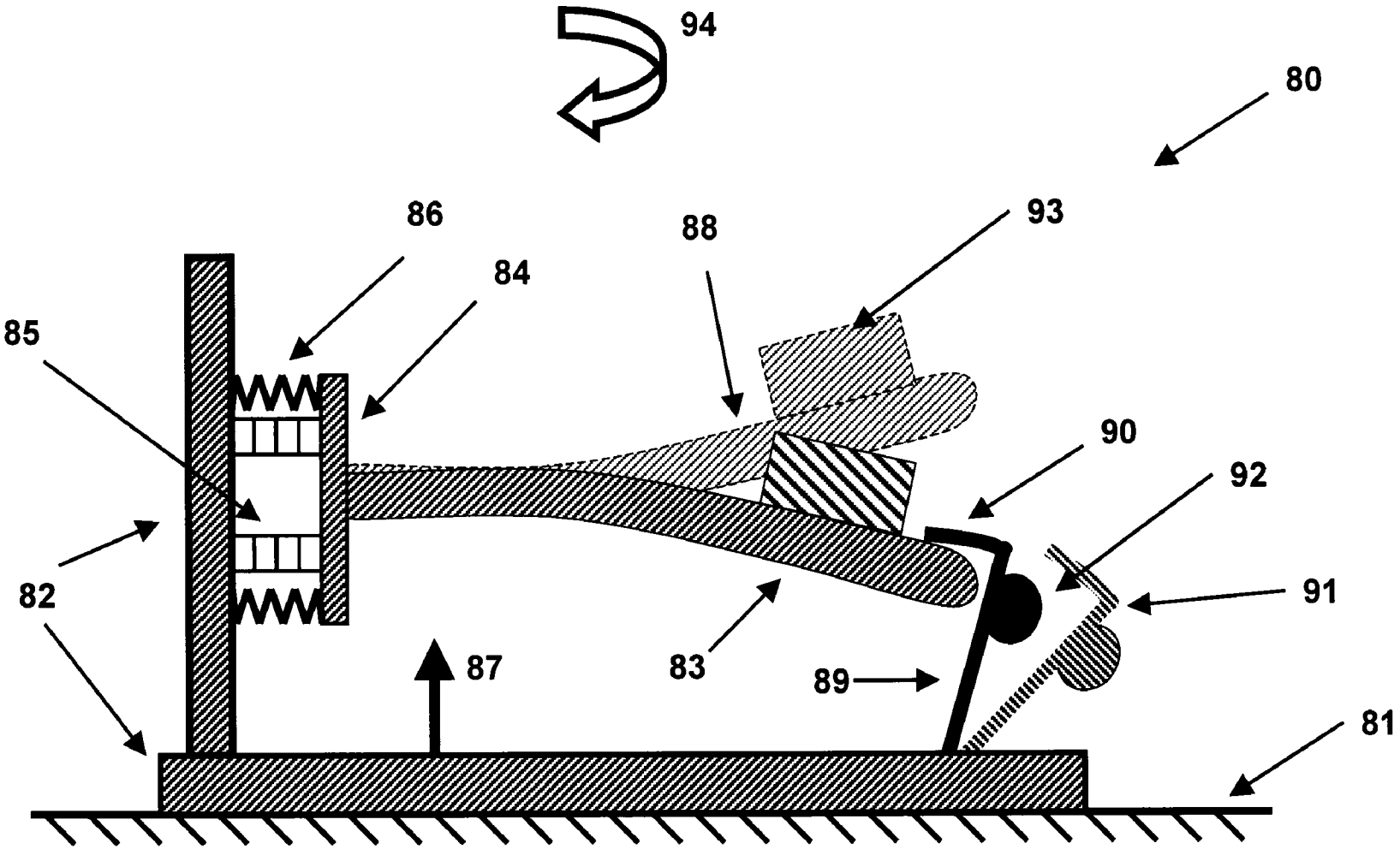
FIG. 5 illustrates a schematic of the embodiment of FIG. 4 with piezoelectric stacks used at the base of the vibrating beam for mechanical to electrical energy conversion.

In an alternative embodiment of the embodiment of FIG. 4, the piezoelectric element used to transform mechanical vibration energy of the vibrating flexible beam 61 to electrical energy is positioned at the base 71 of the flexible beam, between the flexible beam and the base structure of the mechanical reserve power source. The schematic of such an embodiment 80 is shown in FIG. 5. In this embodiment, the base structure of the mechanical reserve power source 82 is attached to base structure of the munitions 81, such as a gun-fired projectile in which it is intended to start to generate electrical energy upon firing. The flexible beam 83 is attached to the power source base structure 82 through at least one piezoelectric element 85 (which can be at least two piezoelectric stacks 85 as shown in FIG. 5). The forces/moments transmitted from the flexible beam 83 to the at least one piezoelectric element 85 is preferably through a relatively rigid intermediate element 84 to better distribute the applied forces over the surface of the at least one piezoelectric element 85. At least one spring element 86 can be used to attach the intermediate element 84 to the power source base structure 82. The at least one spring element 86 is preloaded in tension such that as the flexible beam 83 vibrates as shown between its general upper position 88 and its general lower position 83, piezoelectric elements 85 are not subjected to a significant amount of tensile stresses.

The firing acceleration is considered to be in the direction of the arrow 87. In its pre-firing position, the flexible beam is preloaded in bending to the position 83 from its unloaded (normal) position (not shown) to store the desired amount of mechanical potential energy. The preload beam is then locked in its position 83 by the tip 90 of at least one locking element 89 as shown in FIG. 5.

During the firing of the projectile, the munitions structure 81 is accelerated in the direction 87, causing the firing acceleration to act on the inertia of the at least one locking element 89 and bend it out to the position 91, thereby forcing the tip 90 of the locking element 89 to release the flexible beam 83. The at least one locking element 89 may be provided with additional eccentrically positioned mass (inertia) 92 to increase the aforementioned force that acts on the locking element 89 and tend to move it to the position 91 to release the flexible beam 83. Such additional mass (inertia) may be required if the firing acceleration levels are relatively low or if higher force (moment or torque) levels are required to displace the locking element 89. In general, the locking element 89 is preferably moved towards the position 91 and kept away from the flexible beam 83 (such as by plastic deformation of at least a portion of the locking element 89 or a ratchet mechanism) so that it would not interfere with its subsequent vibration. Once the flexible beam 83 is released, the mechanical potential energy stored in the flexible beam 83, i.e., the mechanical potential energy stored in the present embodiment of the mechanical reserve power sources 80, is released. The released mechanical potential energy will then cause the flexible beam 83 to vibrate. The vibration will then apply a cyclic force/moment to the at least one piezoelectric element 85, thereby generating an electrical charge in the piezoelectric elements, which is then harvested and used directly or stored in certain electrical energy storage device such as a capacitor using electronic regulation and charging circuitry well known in the art.

In general, an additional mass 93 may also be attached to the flexible beam 83, preferably as close as possible to its free end, for the general purpose of reducing the natural frequency of vibration of the beam element to optimize the amount of mechanical energy that is converted to electrical energy. The mass 93 can also be integral to the flexible beam 83.

It is noted that for the embodiment 60 (80) shown in FIG. 4 (5), the spinning of the round, if high enough, about an axis indicated by the arrow 94 (95) would also act on the inertia of the locking element 63 (89) and the mass 65 (92) and generate a force to release the locking element as previously described for these embodiments.

In the embodiment 10 shown in FIG. 1, the locking element 22 is designed to release as the base structure 13 (projectile) is accelerated in the direction of the arrow 14 as the projectile is launched. In this embodiment, the (firing) acceleration in the direction of the arrow 14 acts on the inertia (mass) of the locking element 22 (and the additional mass 15, if present) to generate a force (moment or torque) to release the mass element 20, thereby allowing the potential energy stored in the spring element 21 to cause the mass-spring system to vibrate, thereby generate electrical energy as described earlier. It was also shown that similar releasing forces (moments or torques) are generated by the spinning of the projectile at a high enough rate in the direction of the arrow 52. In this embodiment, both firing acceleration in the direction of the arrow 14 and the spinning about the axial direction 52 tend to release the mass element 20.

Figure 6:
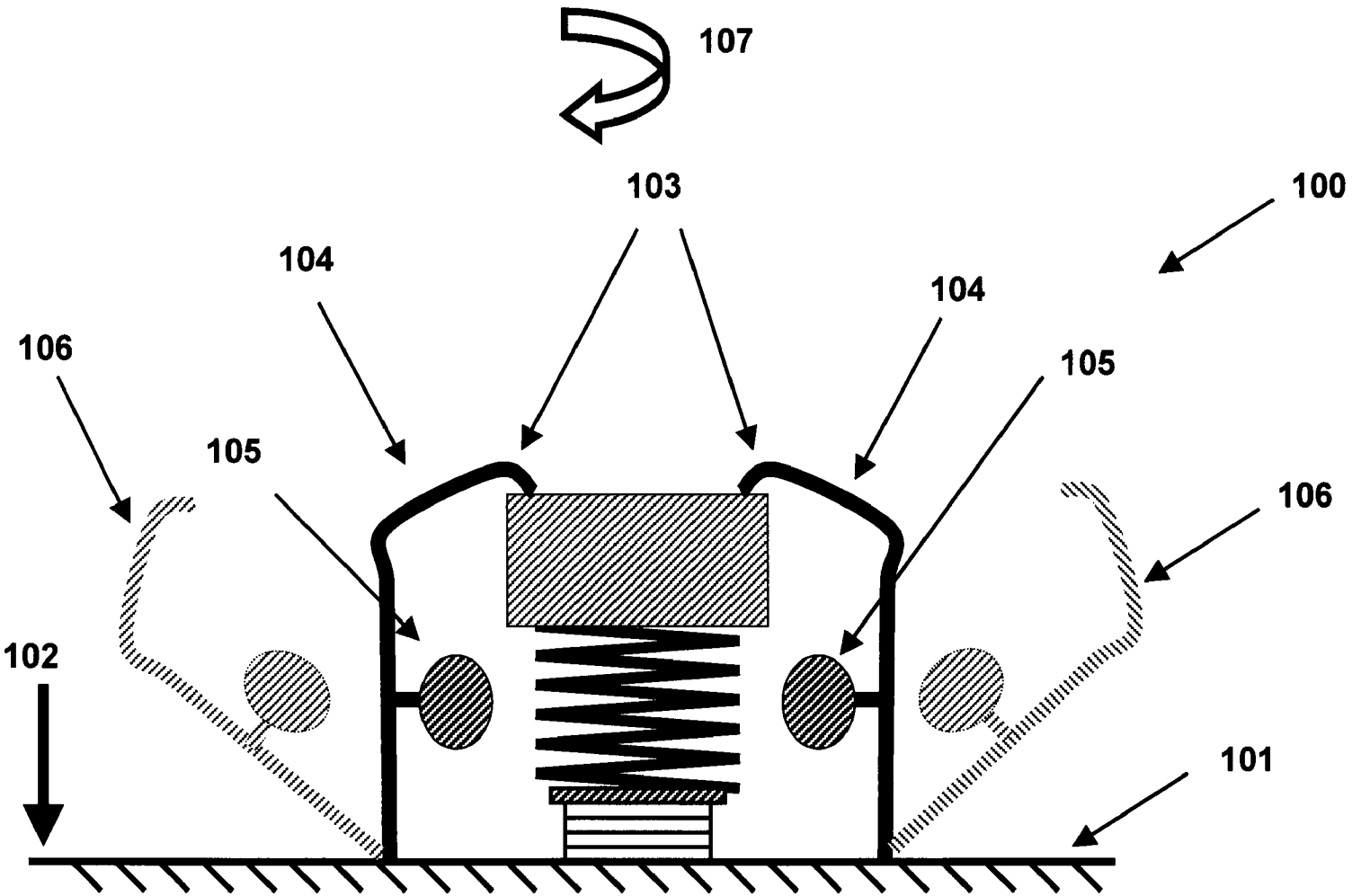
FIG. 6 illustrates an embodiment of a mass-spring and piezoelectric based mechanical reserve power source similar to the embodiment of FIG. 1 for activation by spinning.

In certain applications, however, the locking mechanism may be desired not to be released during the firing acceleration but later during the so-called set-forward acceleration, i.e., the acceleration in the direction opposite to that of the firing (set forward) acceleration, i.e., in the direction opposite to the arrow 14 in FIG. 1. Accelerations in the direction opposite to the direction of the firing acceleration (the direction of the arrow 14) are also experienced by sub-munitions or the like during expulsion from projectiles during the flight. An alternative embodiment 100 of the embodiment 10 that satisfied this requirement is shown in the schematic of FIG. 6. In this schematic, the elements not indicated by numerals are identical to those shown in the schematic of FIG. 1. The mechanical reserve power source 100 is similarly fixed to the structure 101 of the projectile. The firing (setback) acceleration is considered to be in the direction opposite to the arrow 102, while the set-forward acceleration is in the direction of the arrow 102. In this embodiment, the tip 103 of the locking element 104 is similarly used to keep the mass element from being released. A mass element 105 is attached as shown to the locking elements 104. During the firing, the setback acceleration will act on the mass 105 (the mass of the locking element is considered to be small relative to the mass of the element 105), and generate a force that tends to rotate the locking elements inwards, i.e., tend to bring the tips 103 of the locking elements 104 closer to each other. As a result, the mass-spring unit of the mechanical reserve power source 100 is held locked in its pre-firing (preloaded) position. During the set-forward acceleration in the direction of the arrow 102, however, the set forward acceleration acts on the mass 105 of the locking elements 104, and generate a force in the opposite direction, which would tend to rotate the locking elements away from the mass-spring unit of the mechanical reserve power source 100, i.e., tend to move the tips 103 of the locking elements 104 away from each other towards the position indicated as 106, thereby releasing the mass-spring unit of the mechanical reserve power source 100. The released mass-spring unit of the mechanical reserve power source 100 will then begin to vibrate and generate electrical energy as previously described above.

It is noted that for the embodiment 100 shown in FIG. 6, the spinning of the round about its longitudinal axis as indicated by the arrow 107, if high enough, would also act on the inertia of the locking element 104 and the mass 105 and generate a force to release the locking element as previously described for the embodiments 10 and 40.

In other applications, the locking mechanism is not desired to operate and release the vibrating mass of the mechanical reserve power source (e.g., mass 20 in the embodiment 10 shown in FIG. 1) due to the spinning of the projectile, even if the spinning rate is relatively high. In all the above embodiments, the aforementioned locking elements and the added mass element of the locking element (elements 22 and 15, respectively, in the embodiment 10 shown in FIG. 1) may be configured such that the aforementioned vibrating mass is not released as a result of projectile spinning. Here, such locking element and added mass element configuration will be shown as applied to the embodiment 10 of FIG. 1. However, it is appreciated by those familiar with the art that other disclosed embodiments, i.e., embodiments 40, 60, 80 and 100 shown in FIGS. 3-6, and other similar embodiments may also be constructed with the "spin resistant" release mechanism described below.

Figure 7:
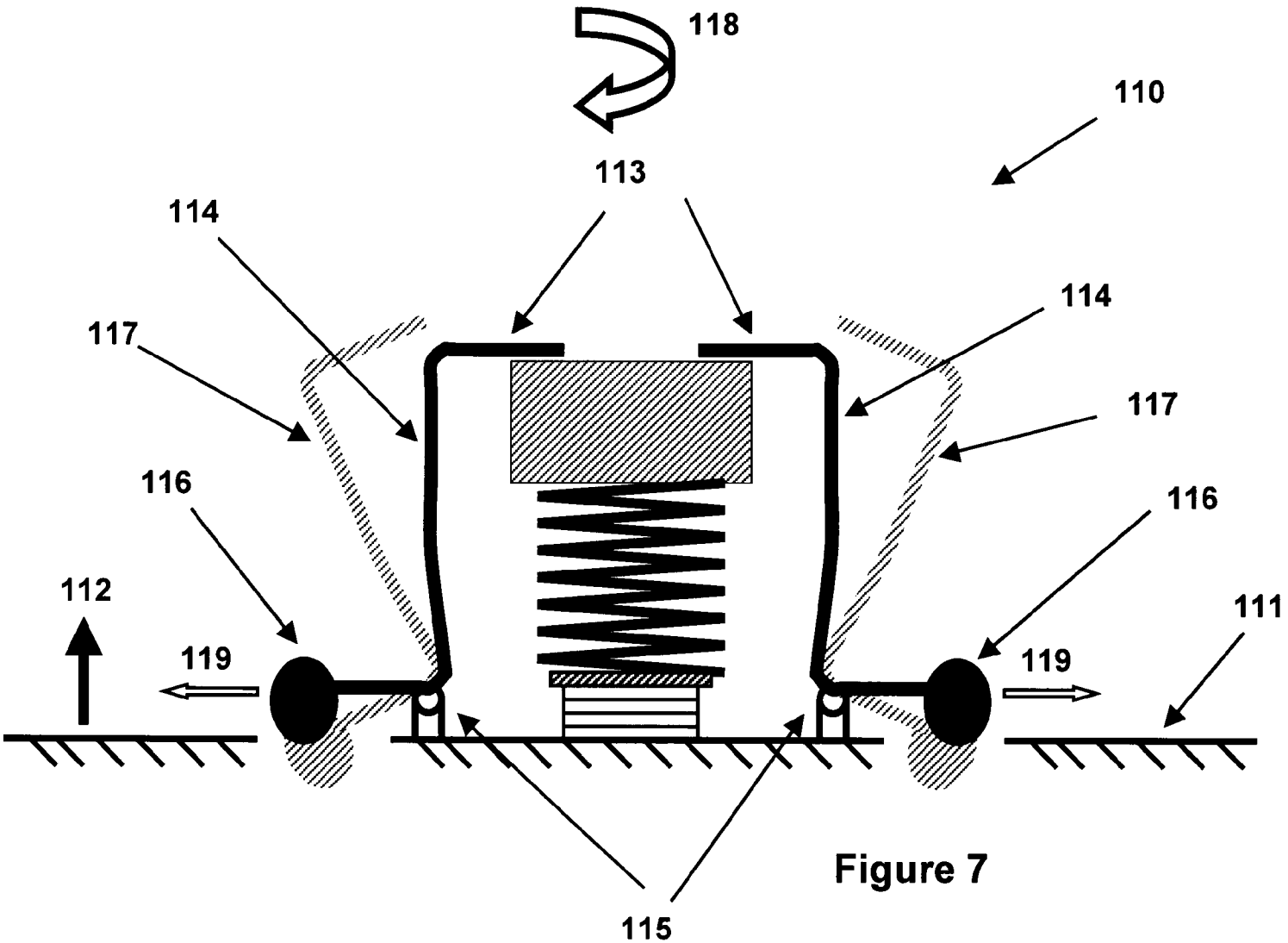
FIG. 7 illustrates an embodiment of a mass-spring and piezoelectric based mechanical reserve power source similar to the embodiment of FIG. 1 for activation by firing (setback) acceleration and insensitivity to spinning.

In this alternative embodiment 110 shown in FIG. 7, the elements not indicated by numerals are identical to those shown in the schematic of FIG. 1. The mechanical reserve power source 110 is similarly fixed to the structure 111 of the projectile. The firing (setback) acceleration is considered to be in the direction of the arrow 112, while the set-forward acceleration is in the direction opposite to the arrow 112. In this embodiment, the tip 113 of the locking element 114 is similarly used to keep the mass element of the mechanical reserve power source from being released. The locking element 114 is attached to the base structure 111 via the hinge joints 115, which can be living joints. A mass element 116 is attached as shown to each locking elements 114. During the firing, the setback acceleration will act on the mass element 116 (the mass of the locking element is considered to be small relative to the mass of the element 116), and generate a force that tends to rotate the locking elements outwards, i.e., tend to move the tips 113 of the locking elements 114 apart and move the locking element 114 and its attached mass element 116 to the position indicated as 117, thereby releasing the mass-spring unit of the mechanical reserve power source 110 and allowing the unit to begin to vibrate. The spinning of the projectile about the axial direction shown by the arrow 118, however, generates centripetal forces shown by the arrows 119 that act laterally on the mass elements 116. However, since the generated centripetal forces 119 act through the hinges 115, they do not generate a moment about these joints and therefore would not tend to rotate the locking elements 114 to release the mass-spring unit of the mechanical reserve power source 110. In general, certain amount of spring preloading (not shown) to bias the locking elements in the direction of locking the mass-spring unit of the mechanical reserve power source 110 and/or frictional force at the joints 115 are provided to provide stable locking of the said mass-spring unit so that it is not accidentally released with a minimal amount of axial acceleration in the direction of the arrow 112 or the like.

Figure 8:
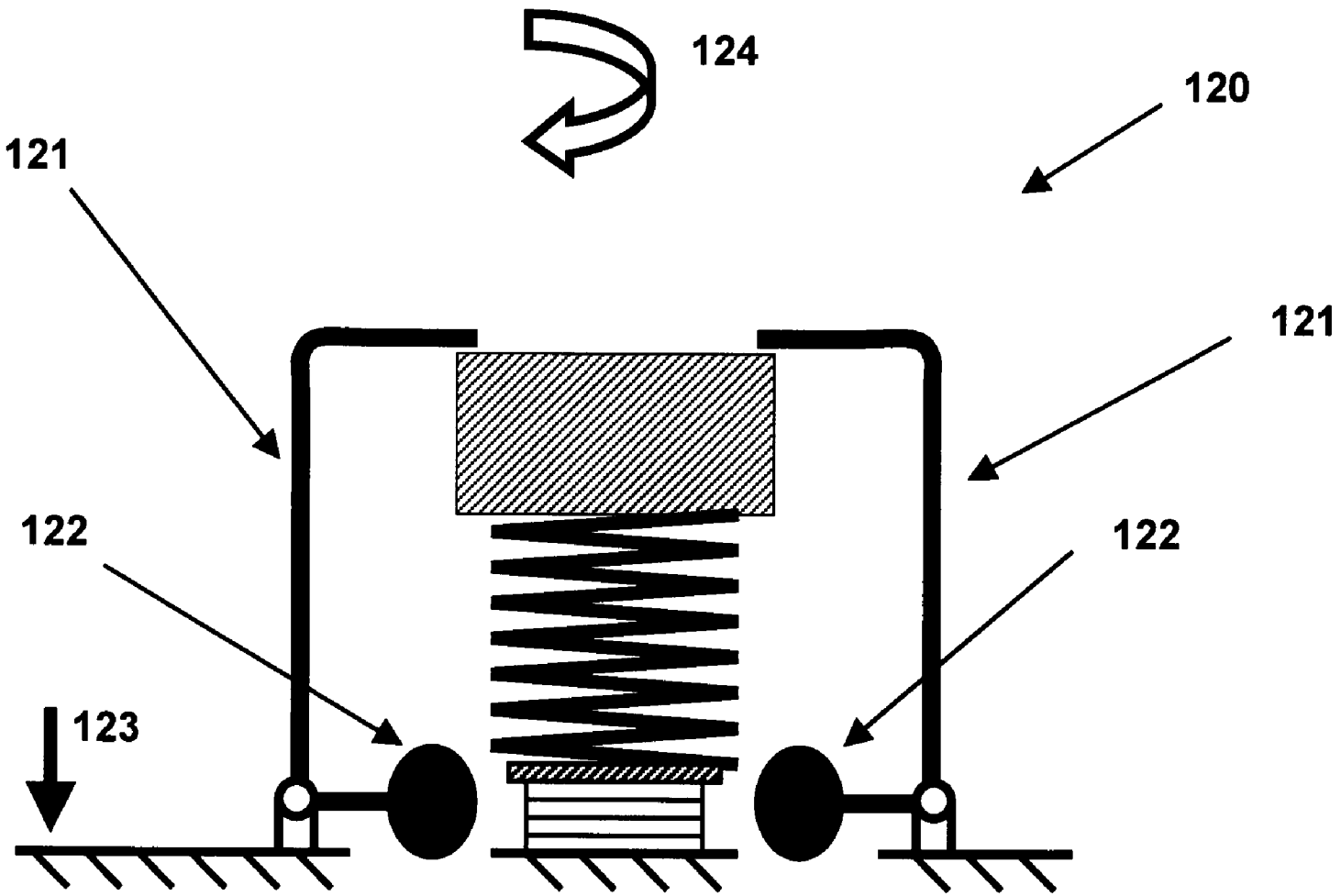
FIG. 8 illustrates an embodiment of a mass-spring and piezoelectric based mechanical reserve power source similar to the embodiment of FIG. 1 for activation by firing setforward acceleration and insensitivity to spinning.

The locking element 114 and its attached mass 116 of the embodiment 110 of FIG. 7 may be readily configured for releasing of the mass-spring unit of the mechanical reserve power source during the set forward acceleration of the projectile, i.e., acceleration in the direction opposite to the arrow 112 similar to the embodiment 100 shown in FIG. 6. This is done by moving the mass 116 to the opposite side of the hinge 115, as shown in the schematic of the embodiment 120 of FIG. 8. In FIG. 8, the elements not indicated by numerals are identical to those shown in the schematic of embodiment 110 of FIG. 7. Here, as shown in FIG. 8, the locking elements 121 are provided with mass elements 122 that are attached as shown on the opposite side of the hinges as compared to the embodiment 110 of FIG. 7. As a result, the mass-spring unit of the mechanical reserve power source is released only during the set forward acceleration of the projectile, i.e., acceleration in the direction of the arrow 123. In addition, the spinning of the projectile about its axial direction as shown with the arrow 124 would not release the mass-spring unit of the mechanical reserve power source for the same reason described previously for the embodiment 110 of FIG. 7.

It is noted that in the above disclosed embodiments, the locking mechanism is shown to be a simple rotating link (beam), which is fixed to the base structure either via a hinge (preferably a living joint), embodiments of FIGS. 7 and 8, or as a cantilever beam, embodiments of FIGS. 1, 3-6, with the beam being provided with an appropriate amount of flexural (bending) flexibility. The mass-spring (vibrating) unit of the mechanical reserve power source is then released due to the movement of the tip of the said locking elements, i.e., the rotation of the aforementioned beam elements, away from the position in which they interfere with the release of the said mass-spring (vibrating) units, upon the application of the setback (firing) acceleration, or set forward acceleration, or the spinning of the projectile to which the power source is attached. In general, such locking mechanisms are among the least complex mechanisms with which the aforementioned desired locking and releasing functionalities can be performed. It is, however, appreciated by those skilled in the art that other acceleration or spin actuated locking mechanisms may also be employed, and that the use of the above rotating link (beam) type of locking mechanisms in the disclosed embodiments is not meant to exclude any other mechanisms that could provide such functionalities, including all those available in the art.

Figure 9:
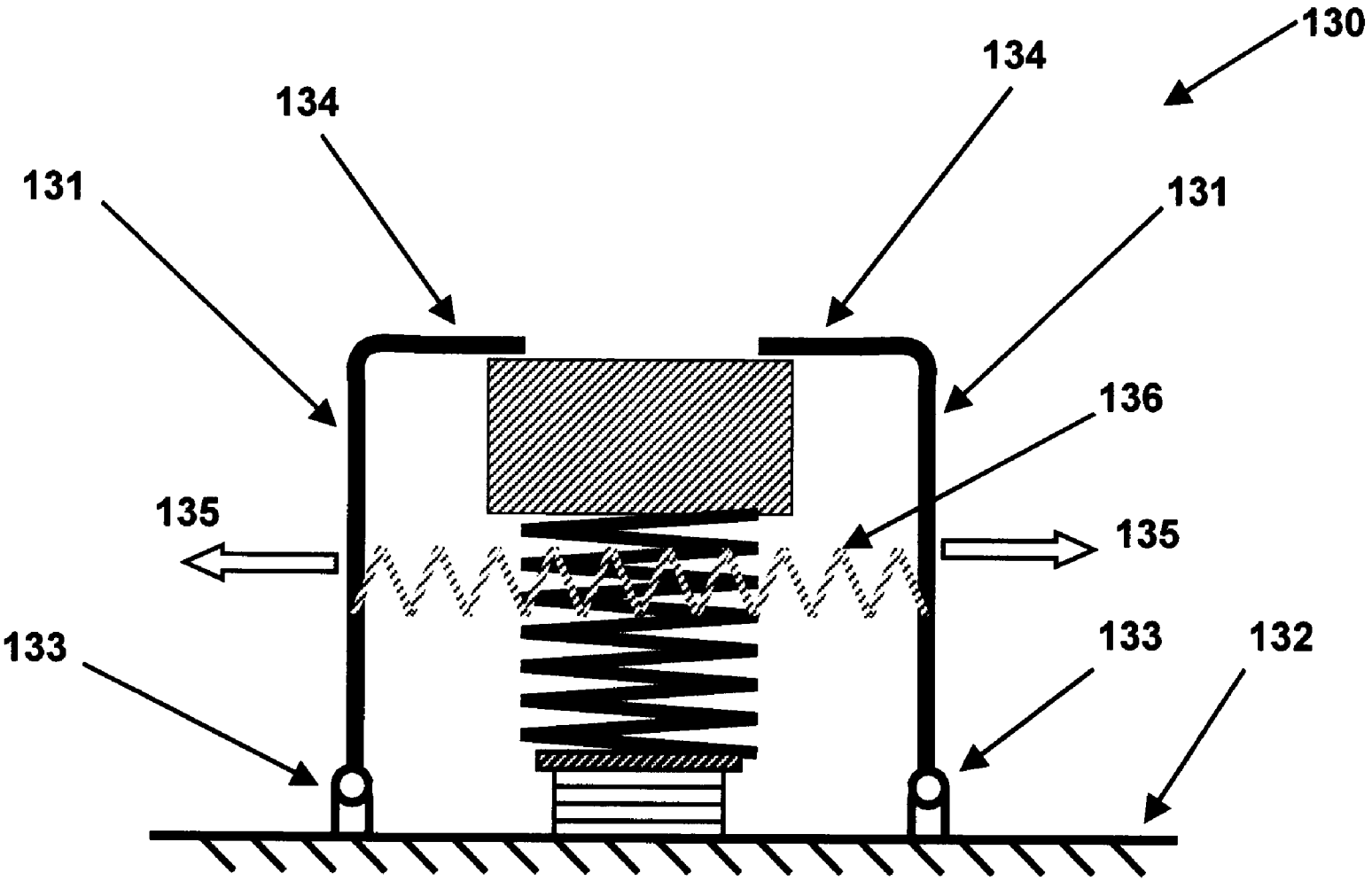
FIG. 9 illustrates an embodiment of a mass-spring and piezoelectric based mechanical reserve power source similar to the embodiment of FIG. 1 for activation by an external actuation (releasing) means.

Another embodiment 130 is shown in the schematic of FIG. 9. The embodiment 130 is similar to the embodiment 10 of FIG. 1, except for its locking mechanism and method of its release. In the embodiment 130 shown in FIG. 9, the elements not indicated by numerals are identical to those shown in the schematic of FIG. 1. In the embodiment 130, the locking mechanism consists of relatively rigid links 131 which are fixed to the munitions or the like structure 132 via joints 133, which can be living joints. In the configuration shown in FIG. 9, the tips 134 of the locking links 131 hold the mass-spring unit of the mechanical reserve power source in its preloaded position as described for the embodiment 10 of FIG. 1. The locking links 131 can be attached together via a spring element 136 which is preloaded in tension so that the mass-spring unit of the mechanical reserve power source may not be accidentally released. The mass-spring unit can be released by applying external forces in the direction of the arrows 135 that would overcome the spring 136 preload and other resisting forces such as friction forces and separate the tips 134 of the links 131 apart to release the mass-spring unit of the mechanical reserve power source, allowing the mass-spring unit to begin to vibrate and generate electrical energy as previously described for the embodiment 10 of FIG. 1. The applied forces 135 are preferably either kept during the vibration of the mass-spring unit or are large enough to deform the links 131 and/or break the spring 136 or both to keep the links 131 from interfering with free vibration of the said mass-spring unit.

Figure 10:
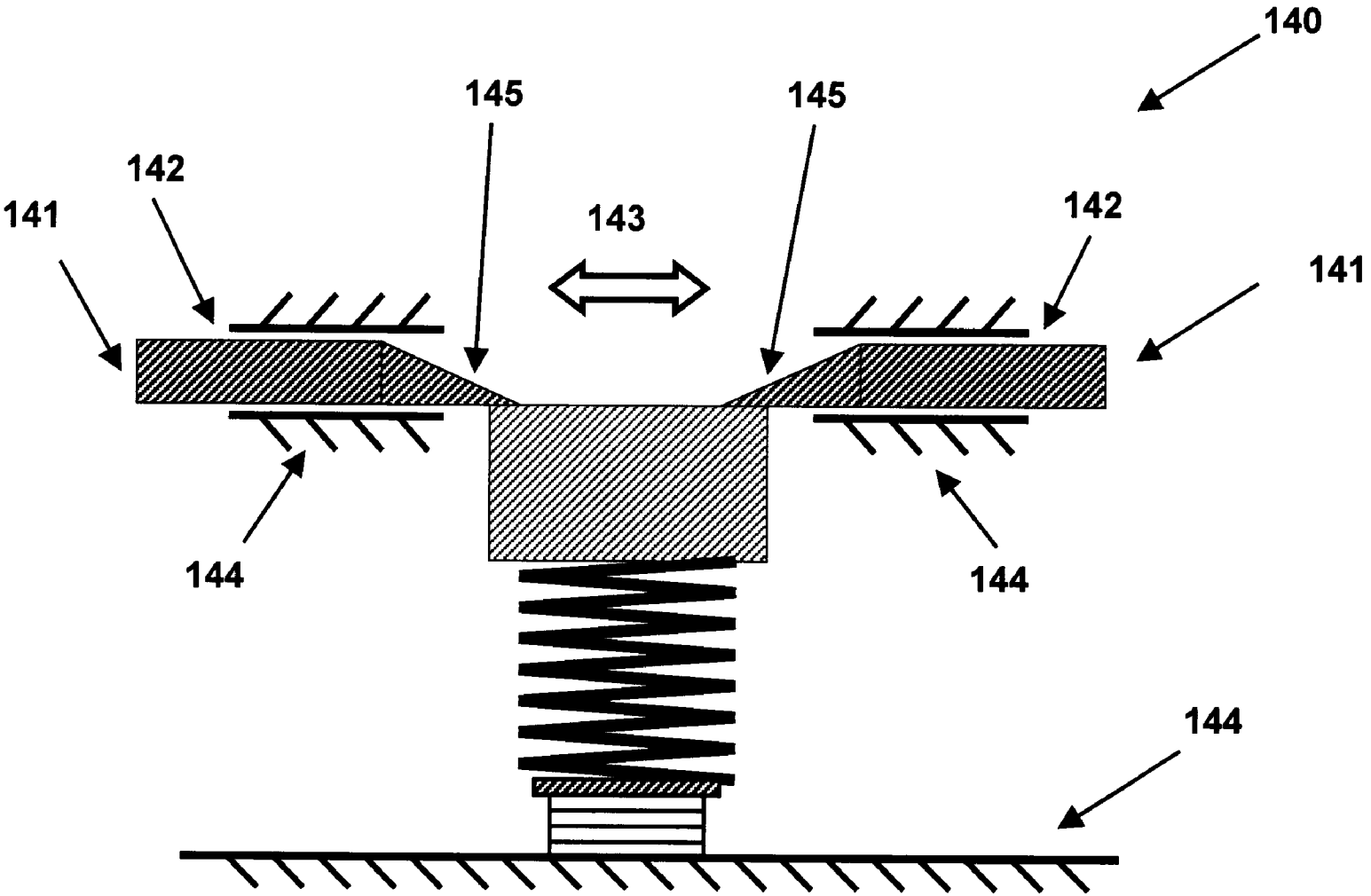
FIG. 10 illustrates an embodiment of a mass-spring and piezoelectric based mechanical reserve power source similar to the embodiment of FIG. 1 for activation by removal of locking stops.

Another embodiment 140 is shown in the schematic of FIG. 10. The embodiment 140 is similar to the embodiment 10 of FIG. 1, except for its locking mechanism and method of its release. In the embodiment 140 shown in FIG. 10, the elements not indicated by numerals are identical to those shown in the schematic of FIG. 1. In the embodiment 140, the locking mechanism consists of relatively rigid locking elements 141 which are provided with the guides 142 along which the can move back and forth in the direction of the arrow 143. The embodiment 140 is fixed to the munitions or the like structure 144. The guides 142 are also similarly fixed to the munitions or the like structure 144. In the configuration shown in FIG. 10, the tips 145 of the locking elements 141 hold the mass-spring unit of the mechanical reserve power source in its preloaded position as described for the embodiment 10 of FIG. 1. The locking elements 141 are preferably provided with means such as friction or springs (not shown) within the guides 142 that would prevent them from accidentally releasing the mass-spring unit of the mechanical reserve power sources. The mass-spring unit of the mechanical reserve power source can then be released by displacing the locking elements 141 back away from the mass-spring unit, thereby allowing the mass-spring unit to begin to vibrate and generate electrical energy as previously described for the embodiment 10 of FIG. 1. Appropriate means such as friction forces or well known locking elements (not shown) are preferably provided to keep the locking elements 141 from interfering with free vibration of the said mass-spring unit.

In the embodiments 130 and 140, the locking elements 131 and 141 may be actuated to release the mass-spring units of the mechanical reserve power sources by any external means depending on the application at hand, including the following:

a) Manually, by pulling a cable, lever or the like attached to the said locking elements.

b) By pulling a cable or the like attached on one end to the locking elements and on the other end to the structure of the system, e.g., an aircraft, from which the weapon to which the mechanical reserve power source is attached is released.

c) By spinning of the munition and the resulting centripetal forces.

Figure 11:
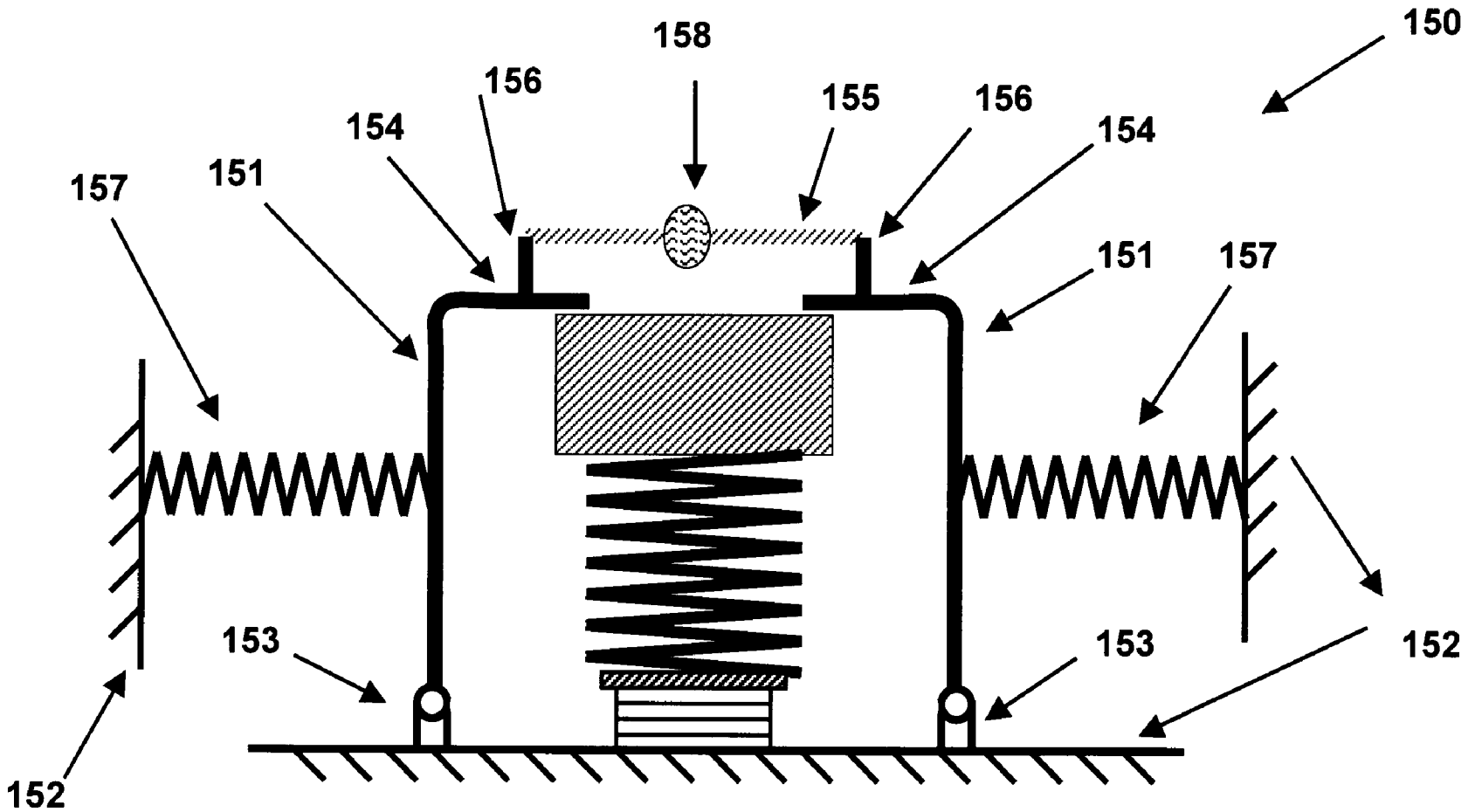
FIG. 11 illustrates an embodiment of a mass-spring and piezoelectric based mechanical reserve power source similar to the embodiment of FIG. 1 for by cutting/releasing of a locking cable.

It will be appreciated by those skilled in the art that many possible means can be used to actuate the locking mechanisms used in the various embodiments (for the embodiments shown in FIGS. 1, 3-8, in addition to the firing setback and set forward accelerations and spinning of the projectiles). One method of such actuation which is appropriate for many munitions is illustrated by its application to the embodiment 150 of FIG. 11. In this method, the locking mechanism is actuated by preloaded springs or the like by cutting a cable or moving a stop, manually or by certain externally applied force or via detonation of a properly positioned charge. An illustrative example of the application of this method to the embodiment 150 is shown in FIG. 11. The embodiment 150 is similar to the embodiment 10 of FIG. 1, except for its locking mechanism and method of its release. In the embodiment 150 shown in FIG. 11, the elements not indicated by numerals are identical to those shown in the schematic of FIG. 1. In the embodiment 150, the locking mechanism consists of relatively rigid locking elements 151 which are fixed to the structure of the munitions 152 via joints 153, which can be living joints. The embodiment 150 is fixed to the munitions or the like structure 152. In the configurations shown in FIG. 11, the tips 154 of the locking elements 151 hold the mass-spring unit of the mechanical reserve power source in its preloaded position as shown in FIG. 11 and described for the embodiment 10 of FIG. 1. The element 155, which can be a cable or the like, and can be relatively inextensible, is used to connect the two locking elements by being fixed to each locking element 151 at points 156, which may be an extension of the locking element 151. The element (cable) 156 prevents the tips 154 of the locking elements 151 from being separated and release the mass-spring unit of the mechanical reserve power source. The springs 157, preloaded in tension, are attached on one end to the locking elements 151 and fixed to the structure of the munitions 152 on the other end. The element 158 is intended to indicate a means of cutting the cable 156, thereby allowing the springs 157 to pull back the locking elements and release the mass-spring unit of the mechanical reserve power source. For munitions, such means 158 may be a detonation charge that is initiated to cut the cable directly or by cutting or pulling of a pin holding a two piece cable together or the like as commonly known in the art. In certain munitions such as in small gravity dropped weapons, an "arming" wire attached to a pin holding a two piece cable together or the like may be used, which is pulled as the weapon is released to free the locking elements 151 to be pulled back by the springs 157, thereby releasing the mass-spring unit of the mechanical reserve power source, thereby allowing the mass-spring unit to begin to vibrate and generate electrical energy as previously described for the embodiment 10 of FIG. 1.

The locking elements 151 can be provided with means such as friction in the joints 153, however, springs 157 act to bias them away from the mass-spring unit and prevent them from interfering with free vibration of the said mass-spring unit.

It is noted that in the embodiments of FIGS. 1-3 and 6-11, the spring element may be of any type, such as helical or any other machined axial springs of appropriate pattern. In particular, machined springs with integrated mass element (as a separate section of the spring—similar to the mass elements shown in the aforementioned embodiments—or utilizing the effective mass of the spring itself) can be used to eliminate the need for mass-to-spring attachment procedures. In either case, the spring element can be resistant to lateral bending. For helical springs or helical-type machined springs, this can be accomplished by using helical springs with more than one strand, preferably at least three strands to make it resistant to bending in all lateral directions.

In the above embodiments, the mechanical energy is stored either in linear (such as helical) springs or in relatively flexible beams. The present mechanical reserve power sources may, however, be designed for rotational vibration of an inertia element (such as a wheel). The mechanical to electrical energy conversion can then be achieved using commonly used magnet and coil (dynamo type) or the like generators or as described for the previous embodiments, using piezoelectric elements. Alternatively, the stored mechanical energy in such mechanical reserve power sources may be transferred to a similar but continuously rotating wheel, essentially as kinetic energy, and using a magnet and coil (dynamo type) or the like generator that is attached (directly or through certain other mechanisms such as a gearing mechanism) to convert the kinetic energy to electrical energy.

Figure 12:
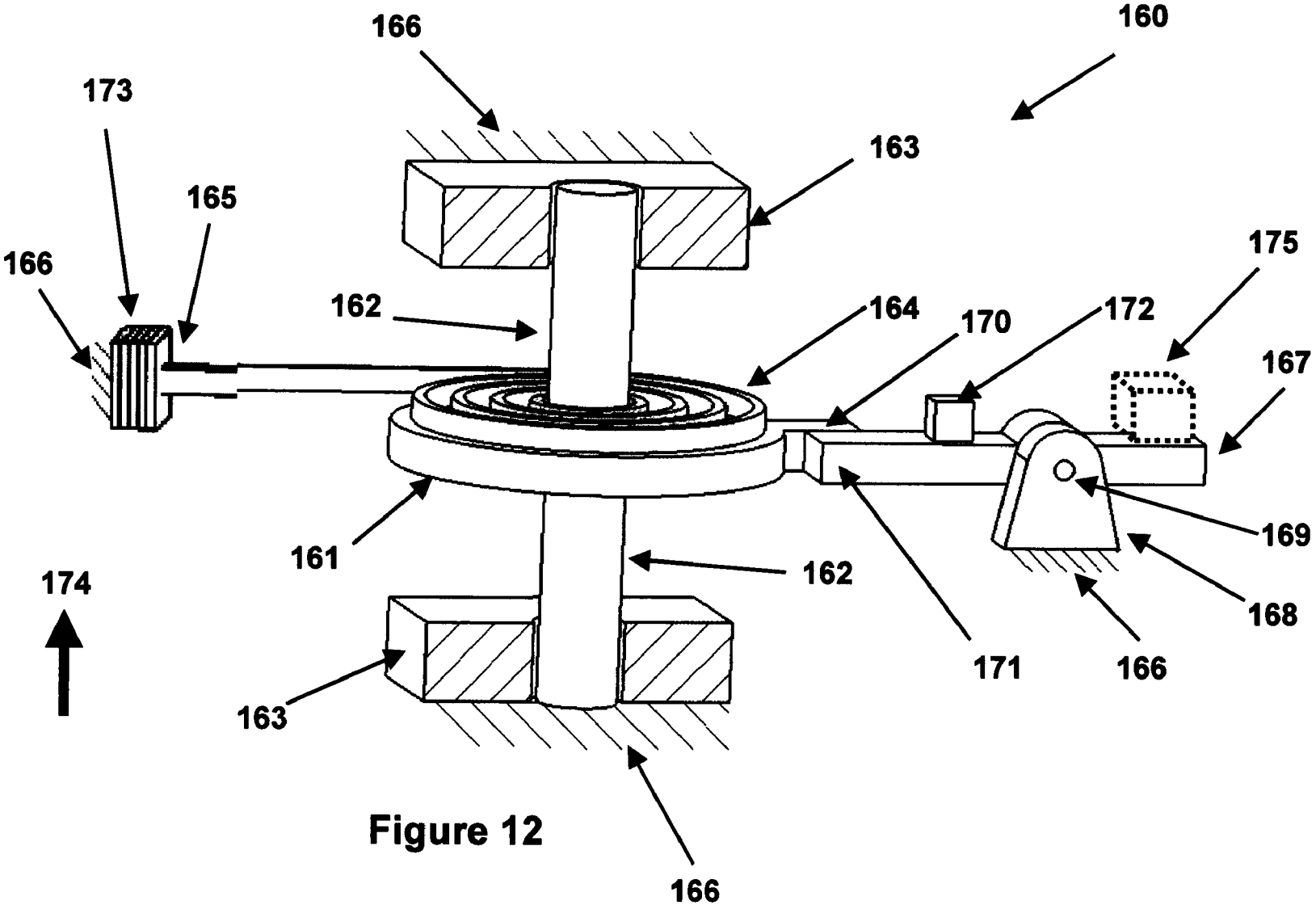
FIG. 12 illustrates an embodiment of the mechanical reserve power source that uses an inertia wheel and torsional spring or the like and piezoelectric stacks for electrical energy generation.

One such embodiment 160 is shown in the schematic of FIG. 12. The mechanical reserve power source 160 consists of a wheel 161, which is attached to the ground 166 (e.g., the structure of a projectile) by at least one shaft 162 via the bearing 163, in which the at least one shaft 162 is free to rotate. The shaft 162 is fixed to the wheel. A torsional spring 164 is attached on one end to the wheel 161 (or the shaft 162) and on the other end 165 to the ground 166 via the piezoelectric element 173. In this configuration, by rotating the wheel 161 in either direction, the torsional spring 164 is preloaded and stores certain amount of potential energy, and when the wheel is released, the wheel 161 and torsional spring 164 unit vibrates (oscillate back and forth) in rotation.

The embodiment is provided with a link 167, which is attached to the support 169 by the rotary joint 168. The support 169 is attached to the structure of the projectile 166. When the link 167 is in the configuration shown in FIG. 12, its tip 171 can engage the extension 170 provided on the wheel 161, preventing it from rotating further in the clockwise direction. Mechanical energy is stored in the torsional spring by rotating the wheel counterclockwise (or clockwise but the tip 171 would then need to be positioned on the opposite side of the extension 170) and bringing the tip 171 to the position shown in FIG. 12 to prevent the wheel 161 from being released. The link 167 is preferably biased to prevent the wheel 161 from being released by minor vibrations and motions of the projectile, for example by friction at the joint 168 or by certain mechanical interference means such as by the engagement of protruding point and a matching dimple (not shown) on the engaging surface of the extension 170 and tip 171.

A mass 172 is provided on the link 167, as shown in FIG. 12, or integral therewith. Then during the firing of the projectile, the munitions structure 166 is accelerated in the direction 174, causing the firing acceleration to act on the mass 172 (the link is considered to be balanced relative to the joint 168), thereby causing the link 167 to rotate clockwise. At some point, the tip 171 clears the extension 170 of the wheel 161, thereby releasing the wheel. In general, link 167 can be rotated clockwise to release the wheel 161 and is kept away so that it would not interfere with their subsequent rotational motion of the wheel 161. Once the wheel 161 is released, the mechanical potential energy stored in the torsional spring 164, i.e., the mechanical potential energy stored in the mechanical reserve power sources 160, is released. The released mechanical potential energy will then cause the wheel 161 and torsional spring 164 unit to begin to vibrate. The vibration will then apply a cyclic force to the piezoelectric stack 173, thereby generating an electrical charge, which is then harvested and used directly or stored in certain electrical energy storage device such as a capacitor using electronic regulation and charging circuitry well known in the art. The piezoelectric stack element 173 is preferably preloaded in compression using one of the methods previously discussed so that it is not subjected to a substantial net tensile stress.

Alternatively, the mechanical reserve power source embodiment 160 of FIG. 12 may be configured not to release during the firing setback but release during the firing set-forward, i.e., as a result of an acceleration of appropriate magnitude in the direction opposite to that of the arrow 174. This is readily accomplished by preventing the link 167 from rotating in the counterclockwise direction, e.g., by providing a stop (not shown) under the link 167.

It will also be appreciated by those skilled in the art that the mass 172 could have been placed on the link but on the opposite side of the joint 169, indicated as the element 175 in dotted lines in FIG. 12. The resulting embodiment will then release the wheel 161 (activate the mechanical reserve power source 160) when subjected to setback acceleration. For activation under set-forward acceleration, the link 167 needs to be prevented from rotating in the clockwise direction during the setback acceleration (i.e., acceleration in the direction of the arrow 174), which is readily accomplished by placing the aforementioned stop (not shown) above the link 167.

In the embodiment of FIG. 12, the mass element 172 and 175 are shown to be separate elements that are attached to the link 167. However, the mass elements 172 and 175 can be integral parts of the link 167. Similarly, the rotary 169 can be a living joint and be plastically deformed away from the wheel 161 following the release of the wheel 161 (activation of the mechanical reserve power source) so that it would not interfere with free vibration of the system.

Figure 13:
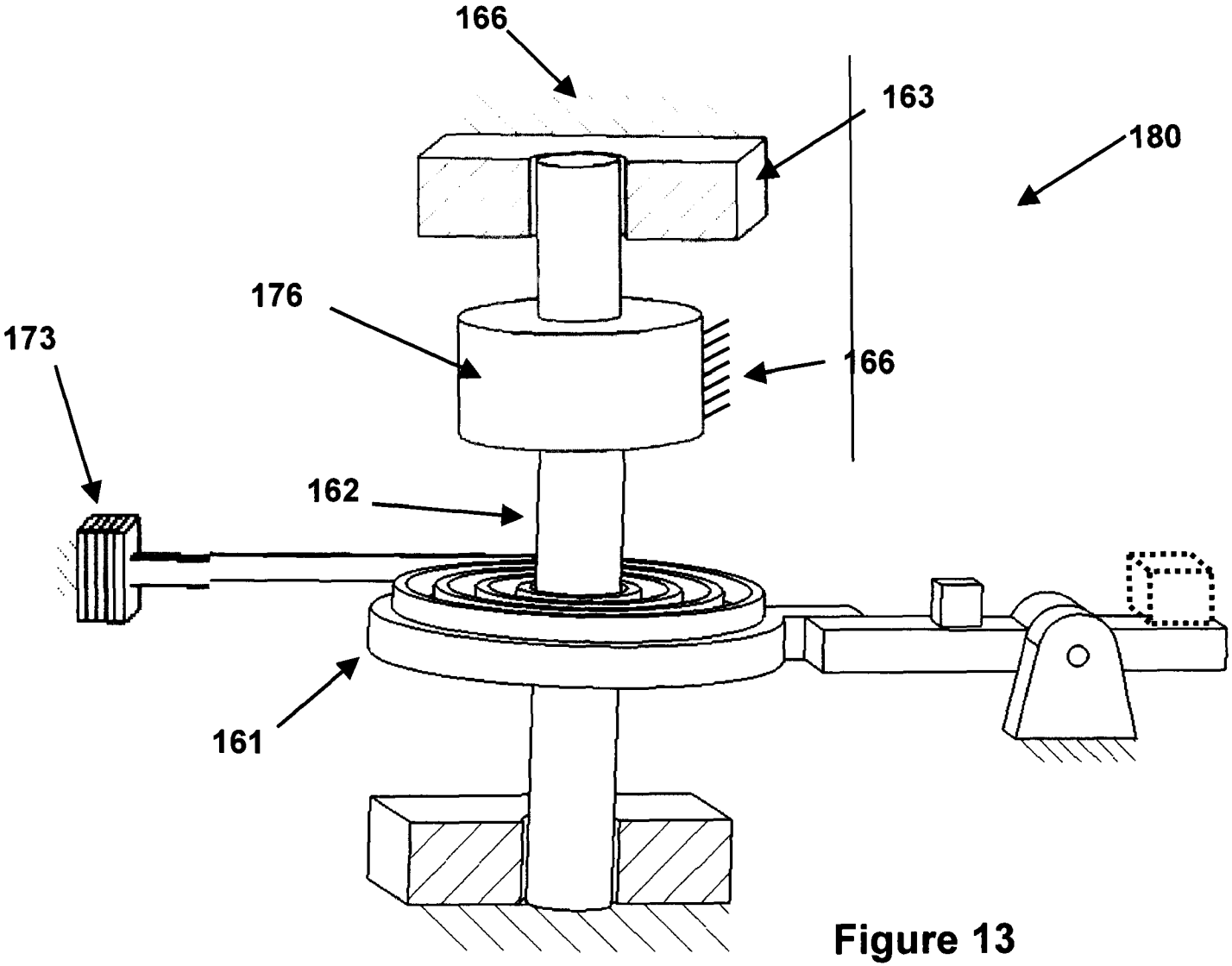
FIG. 13 illustrates an alternative of the embodiment of FIG. 12 in which a magnet and coil (dynamo) generator is used for electrical energy generation.

In the embodiment of FIG. 12, once the wheel 161 is release and the wheel-torsional spring unit begins to vibrate, the mechanical energy stored in the torsional spring 161 is converted to electrical energy as previously described via the piezoelectric (stack) element 173. Alternatively, the mechanical energy can be converted by commonly used magnet and coil generators (dynamos) or any other means of mechanical energy to electrical energy conversion known in the art. In the schematic of FIG. 13, indicated as the embodiment 180, such a magnet and coil (dynamo) type generator 176 is shown to have been positioned along the shaft 162 and its outer housing grounded (attached to the projectile structure 166). As a result, as the wheel-torsional spring unit vibrates, the generator shaft is rotated back and forth, thereby allowing the generator 176 to generate electrical energy, i.e., convert the mechanical energy stored in the mechanical reserve power source to electrical energy. The harvested energy can then be used directly or stored in certain electrical energy storage device such as a capacitor using electronic regulation and charging circuitry well known in the art.

In the embodiment of FIG. 13, the wheel 161 and the generator 176 are separately attached to the shaft 162. It will, however, be appreciated by those skilled in the art that the two units may be combined into a single unit with the wheel 161 constituting the rotor of the generator 176. The extension 170 used for locking the preloaded torsional spring will still be fixed to the shaft 162 and the release link 167 would similarly be rotated by either the setback or set-forward acceleration of the projectile to release the shaft 162 and initiate the aforementioned rotational vibration of the wheel-torsional spring unit to generate electrical energy (FIG. 12).

In the embodiments of FIGS. 12 and 13, the mass of the link 167 and the added mass elements 172 or 175 are shaped such that the center of mass of the resulting structure (link 167 and mass element 172 or 175) lies in line with the rotary joint 169. As a result, if the projectile (indicated by its structure 166) is spinning during its flight (about the firing direction 174 about the longitudinal axis of the projectile), then the centripetal acceleration acting on the mass element 172 or 175 would substantially pass through the rotary joint 169, and would thereby generate no moment about the said rotary joint 169 to tend to rotate the link and release the wheel 161, i.e., activate the mechanical reserve power source 160 or 180.

Figure 14:
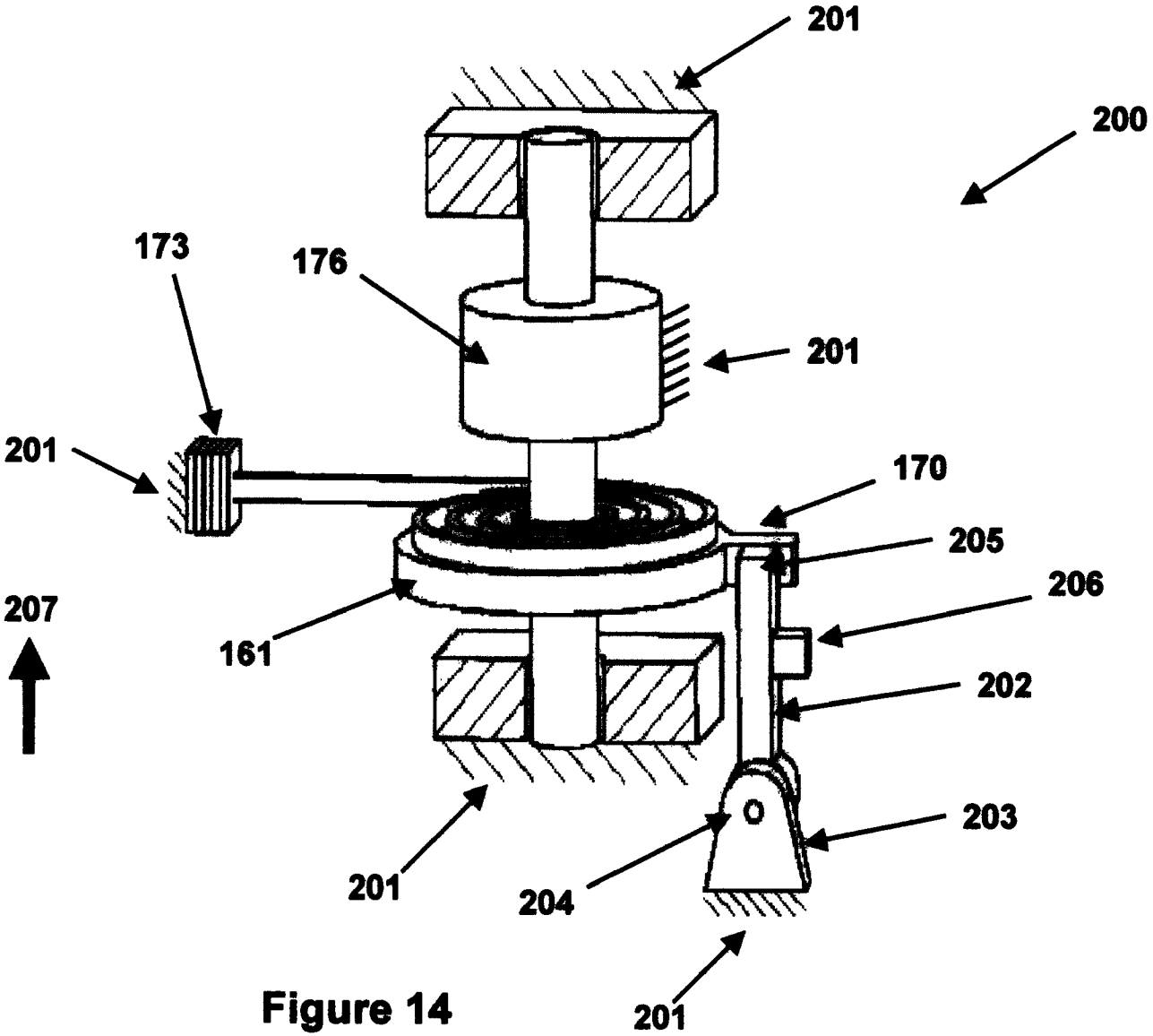
FIG. 14 illustrates another alternative of the embodiment of FIG. 12 in which the mechanical reserve power source is activated by spinning.

Alternatively, the release link assembly may be configured such that the inertia wheel 161 (FIG. 12) is not released as a result of firing acceleration (setback and/or set-forward), but be released only due to the spinning of the projectile along its long axis. One such embodiment 200 is shown in the schematic of FIG. 14. In FIG. 14, all the elements except those of the locking/releasing mechanism (link 167 and associated components) are identical to those of the embodiment of FIG. 12). In the embodiment 200, the locking/releasing mechanism consists of a similar link element 202, which is similarly attached to the projectile structure 201 via a support 203 by the rotary joint 204. The tip 205 of the link 202 similarly engages the extension 170 of the wheel 161, thereby preventing the preloaded torsional spring from unwinding. A mass 206 is also fixed to the link 202. The mass of the link together with the mass of the element 206 are distributed such that the center of mass of their combined body is substantially located on a vertical line passing through the hinge 204. As a result, the firing acceleration (setback or set-forward), which is in the direction of the arrow 207, does not generate a torque on the link 202 and mass 206 assembly about the axis of rotation of the hinge 204, and would thereby not act to rotate the link 202 to release the wheel 161, i.e., to activate the mechanical reserve power source 200. On the other hand, the spinning of the projectile (about the long axis of the projectile, i.e., about a vertical axis parallel to the direction of the arrow 207) would generate a net centrifugal force on the link 202 and when the rate of spinning is above a certain threshold, the torque generated by the centrifugal force about the axis of the hinge 204 overcomes the aforementioned friction and mechanical locking forces that are provided to prevent accidental rotation of the link 202, and rotates the link 202 in the clockwise direction, thereby releasing the wheel 161, i.e., activating the mechanical reserve power source 200. As a result, the wheel-torsional spring unit begins to vibrate. The released mechanical energy can then be converted to electrical energy by either the piezoelectric (stack) element 173 or the magnet and coil generator 176 or both as was described in the previous embodiments. The harvested energy can then be used directly or stored in certain electrical energy storage device such as a capacitor using electronic regulation and charging circuitry well known in the art.

It will also be appreciated by those skilled in the art that the embodiments of FIGS. 12-14 may be configured such that the resulting mechanical reserve power source is activated (i.e., the vibrating wheel is released) by, for example, both setback and set-forward accelerations; or by both setback acceleration and spinning of the projectile; or by both set-forward acceleration and spinning of the projectile; or any other similar combinations of events.

In addition, torsional springs are used in the embodiments of FIGS. 12-14. However, it is appreciated by those familiar with the art that any other type of spring elements such as helical springs, flexible bending type springs, and the like may also be used. In fact, the spring elements (for example of bending or similar types, attached on one end to the wheel and on the other end to the projectile structure) may even be integral to the wheel element of the disclosed mechanical reserve power sources. In a similar manner, any other type of elastic elements may be used in the previous embodiments. In fact, in certain applications, the structure of the projectile itself may be used (entirely or partially) as the elastic element of the mechanical reserve power source for any one of the disclosed embodiments.

In the embodiments of FIGS. 13-14, following the release of the inertia wheel 161, the inertia wheel-torsional spring unit begins to undergo rotary vibration. The system mechanical energy is then transformed to electrical energy by the indicated piezoelectric elements and/or magnet and coil generator. In an alternative embodiment, the torsional spring is attached to the shaft 162 via a one-way clutch. The wheel 161 can then be rotated in the free direction of rotation of the one-way clutch to preload (wind) the torsional spring, and lock the wheel in place at its extension 170 as described for the embodiments of FIGS. 13-14 by the tip 171 (205 in FIG. 14) of the lever 167 (202 in FIG. 14). Then upon the release of the inertia wheel 161 (due to firing accelerations and/or spinning of the round, etc.), the potential energy stored in the torsional spring is transferred to the inertia wheel as kinetic energy and the wheel will start to continuously rotate at certain angular velocity. The magnet and coil type generator 176 can then be used to convert the mechanical (kinetic) energy stored in the inertia wheel 161 to electrical energy. The harvested energy can then be used directly or stored in certain electrical energy storage device such as a capacitor using electronic regulation and charging circuitry well known in the art.

It is noted that in the embodiments of FIGS. 1, 3-8 and 12-14, the mechanical reserve power sources are activated by the firing or centripetal acceleration acting on an inertia element. It will be, however, appreciated by those skilled in the art that release mechanisms of these embodiments could also be activated manually, or by other externally applied forces, such as by a mechanism shown in FIG. 11, i.e., by providing preloaded springs that are released to actuate the release mechanisms of the mechanical reserve power sources methods such as those described for releasing the cable 155 in the embodiment of FIG. 11.

What is claimed is:

1. A power source comprising:

a power generation device;

a mass-spring unit having a mass and an elastic element operatively connected to the power generation device; and one or more retention fingers releasably engaged with the mass-spring unit for retaining the mass-spring unit in a position such that potential energy is stored therein and for releasing the potential energy upon occurrence of an event to generate electrical energy in the power generation device, the one or more retention fingers having a first end fixed at a base and a second end releasably engaged with the mass-spring unit.

2. The power source of claim 1, wherein the elastic element is a helical spring.

3. The power source of claim 1, wherein the elastic element is a cantilevered member.

4. The power source of claim 1, wherein the power generation device comprises one or more piezoelectric elements.

5. The power source of claim 4, wherein the potential energy is released to cause vibration of the mass-spring unit and the vibration is transformed into electrical energy via the one or more piezoelectric elements.

6. The power source of claim 4, wherein the piezoelectric elements comprise one or more stacks of piezoelectric layers.

7. The power source of claim 4, wherein the one or more stacks of piezoelectric layers comprises two or more stacks of piezoelectric layers.

8. The power source of claim 4, further comprising an intermediate rigid element positioned between the elastic element and the one or more piezoelectric elements to uniformly distribute a force applied by the elastic element to the one or more piezoelectric elements.

9. The power source of claim 1, wherein the power generation device is a magnet and coil generator.

10. The power source of claim 1, further comprising an eccentrically positioned mass on each of the one or more retention fingers.

11. The power source of claim 1, wherein the occurrence of the event is an acceleration of the base.

12. The power source of claim 1, wherein the occurrence of the event is a spinning of the base.

13. The power supply of claim 1, wherein the one or more retention fingers are rotatably fixed to the base.

14. The power supply of claim 1, wherein the one or more retention fingers are biased into a position engaged with the mass-spring unit.

15. The power supply of claim 1, wherein the one or more retention fingers are biased into a position out of engagement with the mass-spring unit.

16. The power supply of claim 15, further comprising release means other than an acceleration or spinning of the base for retaining the one or more retention fingers into the engagement with the mass-spring unit and for releasing the engagement of the one or more retention fingers.

17. The power supply of claim 16, wherein the release means comprises an element connected to the one or more retention fingers and a means for disconnecting the connection so as to release the engagement of the one or more retention fingers with the mass-spring unit.

18. The power supply of claim 1, wherein the mass is free to vibrate in an axial direction with respect to the base.

19. The power supply of claim 1, wherein the mass is free to rotate with respect to the base.

20. The power supply of claim 19, where the mass includes one or more shafts rotatably connected to the base.

21. The power supply of claim 19, wherein the elastic member is a torsional spring attached to a face of the mass.

22. The power supply of claim 21, wherein the one or more retention fingers is a retention member rotatably connected to the base and engaged with a projection on the mass.

23. The power supply of claim 21, wherein the power generation device is one or more piezoelectric elements and the torsional spring has an end attached to the one or more piezoelectric elements.

24. The power supply of claim 20, wherein the power generation device is a generator connected to the one or more shafts.

25. The power supply of claim 1, wherein the elastic element is retained in tension to store potential energy.

26. The power supply of claim 1, wherein the elastic element is retained in compression to store potential energy.

27. The power supply of claim 1, wherein the elastic element is retained in rotation to store potential energy.

28. A power source comprising:

a power generation device;

a mass-spring unit having a mass and an elastic element operatively connected to the power generation device; and one or more retention fingers releasably engaged with the mass-spring unit for retaining the mass-spring unit in a position such that potential energy is stored therein and for releasing the potential energy upon occurrence of an event to generate electrical energy in the power generation device, the one or more retention fingers having a first end releasably engaged with the mass-spring unit and being slidable with respect to a base such that the engagement of the first end is released upon a spinning of the base.

29. The power source of claim 28, wherein the one or more retention fingers comprises two or more retention fingers.

30. A power source comprising:

a power generation means for converting potential energy into electrical energy;

a mass-spring means for vibrating upon an occurrence of an event; and retention means releasably engaged with the mass-spring means for retaining the mass-spring unit in a position such that potential energy is stored therein and for releasing the potential energy upon the occurrence of the event to generate electrical energy in the power generation device, the retention means being rotatably engaged with respect to a base.

* * * * *